US011058172B2

(12) United States Patent
Ghiotti

(10) Patent No.: US 11,058,172 B2
(45) Date of Patent: Jul. 13, 2021

(54) FIBER REINFORCED PLATE FOR ARTICLES OF FOOTWEAR AND METHODS OF MAKING

(71) Applicant: Under Armour, Inc., Baltimore, MD (US)

(72) Inventor: Fabien Franco Angelo Ghiotti, Munich (DE)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 16/879,041

(22) Filed: May 20, 2020

(65) Prior Publication Data

US 2020/0275735 A1 Sep. 3, 2020

Related U.S. Application Data

(62) Division of application No. 15/857,257, filed on Dec. 28, 2017, now Pat. No. 10,743,608.

(51) Int. Cl.
*A43B 13/14* (2006.01)
*A43B 13/04* (2006.01)
(Continued)

(52) U.S. Cl.
CPC ..... *A43B 13/14* (2013.01); *A43B 13/026* (2013.01); *A43B 13/04* (2013.01); *A43B 13/12* (2013.01); *D05C 7/00* (2013.01)

(58) Field of Classification Search
CPC ..... A43B 13/026
(Continued)

(56) References Cited

U.S. PATENT DOCUMENTS 616,524 A 12/1898 Cartledge
930,180 A 8/1909 Horn, Jr.
(Continued)

FOREIGN PATENT DOCUMENTS

CN 101632502 A 1/2010
DE 19716666 A1 10/1998
(Continued)

OTHER PUBLICATIONS

International Search Report and Written Opinion dated Mar. 26, 2019 for PCT Application No. PCT/US2018/067604.

*Primary Examiner* — Brent T O'Hern
(74) *Attorney, Agent, or Firm* — Plumsea Law Group, LLC

(57) ABSTRACT

A method of forming a fiber reinforced plate for an article of footwear is described. The method includes embroidering a reinforcing strand to a substrate layer with a thread according to a strand configuration. One or more substrate layers with strand configurations are arranged relative to a base plate. The one or more substrate layers are bonded to the base plate to form the fiber reinforced plate. The reinforcing strands may be formed of a heat fusible material so that adjacent segments of the strands bond to one another and/or the substrate layer. Various strand configurations of reinforcing strands embroidered to substrate layers are described. Multiple substrate layers with different strand configurations can be bonded together with a base plate to form a fiber reinforced plate with reinforcement at selected locations based on the strand configurations.

20 Claims, 15 Drawing Sheets

(51) Int. Cl.
*D05C 7/00* (2006.01)
*A43B 13/12* (2006.01)
*A43B 13/02* (2006.01)

(58) Field of Classification Search
USPC ..... 428/102
See application file for complete search history.

(56) References Cited

U.S. PATENT DOCUMENTS

| | | | |
|---|---|---|---|
| 1,976,885 | A | 10/1934 | Levin |
| 2,018,275 | A | 10/1935 | Markowitz |
| 2,033,096 | A | 3/1936 | Drumheller |
| 2,111,472 | A | 3/1938 | Horn |
| 2,440,393 | A | 4/1948 | Clark |
| 2,508,078 | A | 5/1950 | Rowley et al. |
| 3,389,582 | A | 6/1958 | Alexander |
| 3,115,693 | A | 12/1963 | Chandler |
| 3,348,389 | A | 10/1967 | Platnick |
| 3,672,187 | A | 6/1972 | Simpson |
| 3,964,277 | A | 6/1976 | Miles |
| 4,244,199 | A | 1/1981 | Rhode |
| 4,518,640 | A | 5/1985 | Wilkens |
| 4,559,724 | A | 12/1985 | Norton |
| 4,682,480 | A | 7/1987 | Schnegg |
| 5,299,435 | A | 4/1994 | Whalley |
| 5,345,368 | A | 9/1994 | Nishida |
| 5,406,723 | A | 4/1995 | Okajima |
| 5,615,562 | A | 4/1997 | Roell |
| 6,151,922 | A | 11/2000 | Shimasaki |
| 6,708,427 | B2 | 3/2004 | Sussmann et al. |
| 6,840,066 | B2 | 1/2005 | Dickerson |
| 6,984,596 | B2 | 1/2006 | Dickerson |
| 7,546,698 | B2 | 6/2009 | Meschter |
| 8,122,616 | B2 | 2/2012 | Meschter et al. |
| 8,266,827 | B2 | 9/2012 | Dojan et al. |
| 8,464,441 | B2 | 6/2013 | Meschter et al. |
| 8,490,299 | B2 | 7/2013 | Dua et al. |
| 8,839,532 | B2 | 9/2014 | Huffa et al. |
| 8,915,101 | B2 | 12/2014 | Koizumi |
| 8,959,959 | B1 | 2/2015 | Podhajny |
| 9,060,570 | B2 | 6/2015 | Huffa et al. |
| 9,510,637 | B2 | 12/2016 | Podhajny et al. |
| 10,349,700 | B2 | 7/2019 | Amis et al. |
| 2003/0064232 | A1 | 4/2003 | Allen et al. |
| 2004/0000071 | A1 | 1/2004 | Auger et al. |
| 2004/0074111 | A1 | 4/2004 | Oorei |
| 2006/0116500 | A1 | 6/2006 | Chapman et al. |
| 2006/0269923 | A1 | 11/2006 | Trotta |
| 2008/0010863 | A1 | 1/2008 | Auger et al. |
| 2009/0064538 | A1 | 3/2009 | Roether et al. |
| 2010/0018075 | A1 | 1/2010 | Meschter et al. |
| 2010/0251491 | A1 | 10/2010 | Dojan et al. |
| 2011/0041359 | A1 | 2/2011 | Dojan et al. |
| 2011/0088287 | A1 | 4/2011 | Auger et al. |
| 2012/0233882 | A1 | 9/2012 | Huffa et al. |
| 2012/0255201 | A1 | 10/2012 | Little |
| 2013/0186506 | A1 | 7/2013 | Cross et al. |
| 2013/0323458 | A1 | 12/2013 | Meschter et al. |
| 2014/0068880 | A1 | 3/2014 | Torrance et al. |
| 2014/0115930 | A1 | 5/2014 | Svensson |
| 2014/0173938 | A1 | 6/2014 | Beye et al. |
| 2014/0235393 | A1 | 8/2014 | Sakanaka et al. |
| 2014/0237861 | A1 | 8/2014 | Podhajny |
| 2014/0245546 | A1* | 9/2014 | Huffa ..... A43B 1/04 12/145 |
| 2014/0310983 | A1 | 10/2014 | Tamm et al. |
| 2014/0310986 | A1 | 10/2014 | Tamm et al. |
| 2015/0101133 | A1 | 4/2015 | Manz et al. |
| 2015/0101134 | A1 | 4/2015 | Manz et al. |
| 2015/0272274 | A1 | 10/2015 | Berns et al. |
| 2015/0342286 | A1 | 12/2015 | Huffman et al. |
| 2016/0128911 | A1 | 5/2016 | Fontein et al. |
| 2016/0206039 | A1 | 7/2016 | Cross et al. |
| 2016/0206040 | A1 | 7/2016 | Cross et al. |
| 2016/0286898 | A1 | 10/2016 | Manz et al. |
| 2016/0316855 | A1 | 11/2016 | Berns et al. |
| 2016/0316856 | A1 | 11/2016 | Berns et al. |
| 2016/0332340 | A1 | 11/2016 | Rijpkema |
| 2017/0156434 | A1 | 6/2017 | Tamm et al. |

FOREIGN PATENT DOCUMENTS

| | | | |
|---|---|---|---|
| DE | 102005034401 | A1 | 2/2007 |
| DE | 202009018763 | U1 | 2/2013 |
| DE | 202014105090 | U1 | 12/2014 |
| DE | 102013221018 | A1 | 4/2015 |
| DE | 102013221020 | A1 | 4/2015 |
| DE | 102015205751 | A1 | 6/2016 |
| EP | 1553220 | A1 | 7/2005 |
| EP | 1613159 | | 1/2006 |
| EP | 1916323 | A2 | 4/2008 |
| EP | 2368454 | A1 | 9/2011 |
| EP | 2568067 | A2 | 3/2013 |
| JP | 60011339 | A | 1/1985 |
| WO | 97/43919 | A1 | 11/1997 |
| WO | 2016044547 | | 3/2016 |
| WO | 2017079502 | | 5/2017 |
| WO | 2019133662 | A1 | 7/2019 |

* cited by examiner

FIBER REINFORCED PLATE FOR ARTICLES OF FOOTWEAR AND METHODS OF MAKING

CROSS-REFERENCE TO RELATED APPLICATION

This application claims priority to and is a division of U.S. application Ser. No. 15/857,257, filed Dec. 28, 2017, and titled "Fiber Reinforced Plate for Articles of Footwear and Methods of Making," the entirety of which application is herein incorporated by reference.

BACKGROUND

Embroidery is a traditional method of decorating, tailoring, mending, patching, or reinforcing textile materials by sewing with a needle and stitching material. Hand embroidered goods date back as late as the Warring States period in China. During the industrial revolution, the invention of the sewing machine and dedicated embroidery machines expanded the use of the technique. Modern embroidery techniques may utilize machine readable code to autonomously create an embroidery pattern on a sheet of textile materials. Textile materials include fabrics such as cotton, wool or silk, as well as leather, foam, polymer sheets, and synthetic equivalents. On the textile materials, a number of stitch techniques may be used depending on the purpose of the embroidery, such as the chain stitch, the buttonhole or blanket stitch, the running stitch, the satin stitch, or the cross stitch. The stitching techniques may be used in combination to form a variety of set patterns. The stitching patterns may be decorative, for example the pattern may form a flower or series of flowers. Alternatively the stitching may be structural, such as stitching along the edges of a garment to reinforce the seams. In further cases the stitching may be both decorative and functional, such as the use of a floral pattern use to reinforce a patch.

Typically a thread or yarn is used as the stitching material and stitched into the textile. Commonly the thread or yarn may be made of cotton or rayon, as well as traditional materials like wool, linen or silk. However, embroidery may also sew in dissimilar materials to the textile, usually for decorative purposes. For example, thread created out of precious metals such as gold or silver may be embroidered within more traditional fabrics such as silk. Additional elements may be sewn in during embroidery, such as beads, quills, sequins, pearls or entire strips of metal. These elements may be sewn in along with yarn or thread using variety of stitching techniques depending on the desired placements of the elements.

SUMMARY

In one aspect, the invention comprises a method of forming a reinforced plate for an article of footwear. The method includes embroidering a reinforcing strand to a substrate layer according to a strand configuration. The method also includes attaching the substrate layer having the reinforcing strand to a base plate to form the reinforced plate.

In another aspect, the invention comprises a method of forming a reinforced sole structure for an article of footwear, the method comprising attaching a reinforcing strand to a substrate layer according to a first strand configuration, the reinforcing strand being attached so that a first strand segment is disposed adjacent a second strand segment and the method including heating the reinforcing strand and the substrate layer so the first strand segment and the second strand segment fuse together.

In another aspect, the invention comprises a reinforced plate for an article of footwear. The reinforced plate includes a base plate. The reinforced plate also includes a first substrate layer disposed on the base plate. The first substrate layer can include a first reinforcing strand embroidered onto the first substrate layer according to a first strand configuration. The reinforced plate also includes a second substrate layer disposed on one of the first substrate layer or the base plate. The second substrate layer can include a second reinforcing strand embroidered onto the second substrate layer according to a second strand configuration.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

Figure 1:
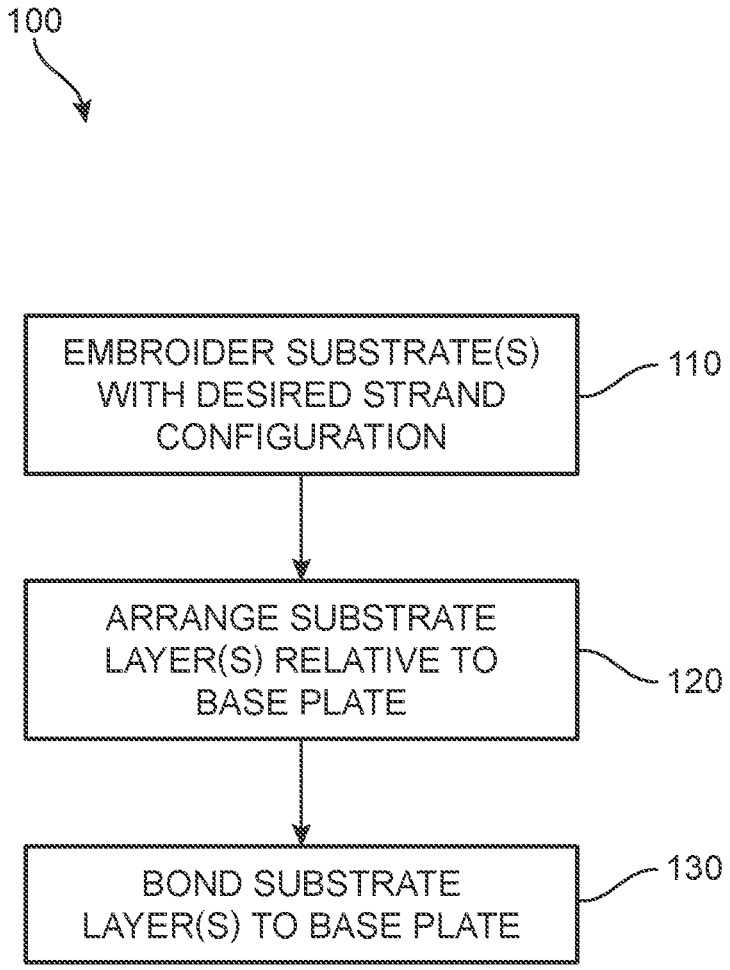
FIG. 1 is a schematic view of an exemplary process for forming a reinforced plate for an article of footwear, according to an embodiment.

In the following detailed description, reference is made to the accompanying figures which form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure are synonymous.

The embodiments shown in FIGS. 1-15 are related to a fiber reinforced plate and associated methods of making a fiber reinforced plate for an article of footwear. Articles of footwear include, but are not limited to: hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports related footwear, including, but not limited to: slippers, sandals, high heeled footwear, loafers as well as any other kinds of footwear.

In the illustrated embodiments of FIGS. 1-15, examples of reinforced plates formed using embroidered substrate layers are shown. In other embodiments, the principles and methods disclosed herein with regard to the illustrated embodiments may be used to form any one or more components of a plate for a sole assembly of an article of footwear, including, but not limited to a sockliner, insole, midsole, outsole, and/or portions thereof.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

For purposes of general reference, a plate for an article of footwear, an article of footwear, or individual components of a sole assembly or article of footwear, may be divided into three regions: a forefoot region, a midfoot region, and a heel region. The forefoot region may be generally associated with the toes and joints connecting the metatarsals with the phalanges. The midfoot region may be generally associated with the arch of a foot, including the instep. Likewise, the heel region or "hindfoot" may be generally associated with the heel of a foot, including the calcaneus bone. For purposes of this disclosure, the following directional terms, when used in reference to an article of footwear or its components, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear or its components extends from a forefoot region to a heel region of the article of footwear. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between a medial side and a lateral side of an article of footwear or its components, with the lateral side being the surface that faces away from the other foot, and the medial side being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear, including a plate and/or other individual components of a sole assembly or article of footwear. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The term "side," as used in this specification and in the claims, refers to any portion of a component facing generally in a lateral, medial, forward, or rearward direction, as opposed to an upward or downward direction. The term "lateral side" refers to any component facing in general toward the lateral direction. The term "medial side" refers to any component facing in general towards the medial direction.

It will be understood that the forefoot region, the midfoot region, and the heel region are only intended for purposes of description and are not intended to demarcate precise regions of an article of footwear or its components. For example, in some cases, one or more of the regions may overlap. Likewise, the medial side and the lateral side are intended to represent generally two sides, rather than precisely demarcating an article of footwear or its components into two halves. In addition, the forefoot region, the midfoot region, and the heel region, as well as the medial side and the lateral side, may also be applied to individual components of an article of footwear, including a plate, a sole assembly, an upper, a lacing system, and/or any other component associated with the article.

In some embodiments, a plate for an article of footwear can be reinforced at selected locations by providing one or more embroidered substrate layers that include a strand or fiber embroidered on the substrate layer at various locations to provide the desired reinforcement to the plate. Additional or different reinforcement can be provided by varying the number and/or selection of substrate layers to reinforce selected areas of the plate. For example, different reinforcement can be provided to a plate based on the type of article of footwear or the sport and/or activity for which the article of footwear including the reinforced plate is configured to be worn.

An exemplary method of forming a fiber reinforced plate for an article of footwear includes using an embroidery process to locate fibers or strands relative to a substrate layer or base layer and joining one or more embroidered substrate layers to a base plate to form the fiber reinforced plate for the article of footwear. Referring to FIG. 1, an exemplary method 100 for forming a fiber reinforced plate for an article of footwear is illustrated. In some embodiments, exemplary method 100 can include a step 110 of embroidering one or more substrate materials with desired strand configurations. As discussed above, desired strand configurations may vary based on type of article of footwear and/or the sport and/or activity for which the article of footwear including the reinforced plate is configured to be worn.

Exemplary method 100 further includes a step 120 of arranging one or more substrate layers relative to a base plate. The arrangement and order of the various substrate layers can be determined based on the strand configurations of the individual substrate layer. In some cases, a strand configuration may be configured to provide reinforcement to a specific component of a sole assembly or article of footwear. For example, a substrate layer can be configured with a strand configuration that provides reinforcement to areas of the plate and/or sole assembly where cleats, studs, or other traction members may be located.

Once the order and arrangement of the one or more substrate layers is determined in step 120, exemplary method 100 includes a step 130 of bonding the one or more substrate layers to the base plate. As will be further discussed below, in some case, substrate layers may be formed of a material that facilitates bonding with the base plate. Once step 130 is completed to bond the substrate layers to the base plate, the fiber reinforced plate may be incorporated into a sole assembly and/or an article of footwear. It should be understood that exemplary method 100 may include additional or optional steps not shown in FIG. 1. For example, additional components may be molded onto the base plate and/or substrate layers, either as part of the bonding process of step 130 or in a separate step. Additionally, other finishing steps and processes may be performed to prepare the reinforced plate for incorporation into a sole assembly and/or article of footwear.

In the present embodiments, an embroidery process is used to locate a reinforcing strand relative to a substrate material layer. A reinforcing strand can be made from a variety of materials or combination of materials. Examples of reinforcing strands include, but are not limited to carbon, para-aramid, and/or fiberglass strands. Additionally, reinforcing strands may also include composite yarns combining thermoplastic yarns with carbon, para-aramid, and/or fiberglass fibers. Composite yarns may be formed by commingling, twisting, coating, and/or winding thermoplastic yarns and carbon, para-aramid, and/or fiberglass fibers together to form the composite yarn. A variety of thermoplastic yarns (e.g., TPU) with different transition and melting temperatures may be used in composite yarns.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.).

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above. Examples of materials that may be utilized include cotton, polyester, nylon, polypropylene, polyethylene, acrylics, wool, acetate, polyacrylonitrile, and combinations thereof. Natural fibers also include cellulosic fibers (e.g., cotton, bamboo) or protein fibers (e.g., wool, silk, and soybean).

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for weaving, or otherwise intertwining to form a textile fabric. Yarn can occur in a variety of forms to include a spun yarn containing staple fibers usually bound together by twist; a multi filament yarn containing many continuous filaments or strands; or a mono filament yarn which consists of a single strand.

The term "composite yarn" refers to a yarn prepared from two or more yarns (or "ends"), which can be the same or different. Composite yarn can occur in a variety of forms wherein the two or more ends are in differing orientations relative to one another, so long as the final composite yarn containing the two or more ends is stably assembled (i.e. will remain intact unless forcibly separated or disassembled). The two or more ends can, for example, be parallel, wrapped one around the other(s), twisted together, or combinations of any or all of these, as well as other orientations, depending on the properties of the composite yarn desired.

The embodiments may generally use any of the methods, techniques, processes, systems, machines and/or equipment disclosed in Berns et al., U.S. Patent Application Publication Number 2016/0316856, published Nov. 3, 2016 and titled "Footwear Upper Including Strand Layers"; Berns et al., U.S. Patent Application Publication Number 2016/0316855, published Nov. 3, 2016 and titled "Footwear Upper Including Variable Stitch Density"; and Berns et al., U.S. Patent Application Publication Number 2015/0272274, published Oct. 1, 2015 and titled "Footwear Including Textile Element," the entirety of each application being herein incorporated by reference.

Generally, a substrate layer provided as a base layer for embroidering a reinforcing strand includes at least an element made of a textile. In some embodiments, the textile is a fabric made of material such as silk, wool or cotton. In other embodiments, the textile is made of synthetic equivalents, such as polyvinyl acetate (PVA), thermoplastic polyurethane (TPU), or ethylene vinyl acetate (EVA). In general, a fabric comprises a series of yarns, fibers, filaments or strands in a networked pattern made by weaving, knitting, spreading, crocheting, or bonding the yarns, fibers, filaments or strands together. In still other embodiments the textile may be leather, foam, synthetic equivalents of leather, or single sheet materials such as plastic or vinyl sheets. In still further embodiments, a substrate layer or base layer may be a backing layer comprised of a material able to dissolve or melt as needed, such as TPU, PVA or EVA.

Figure 2:
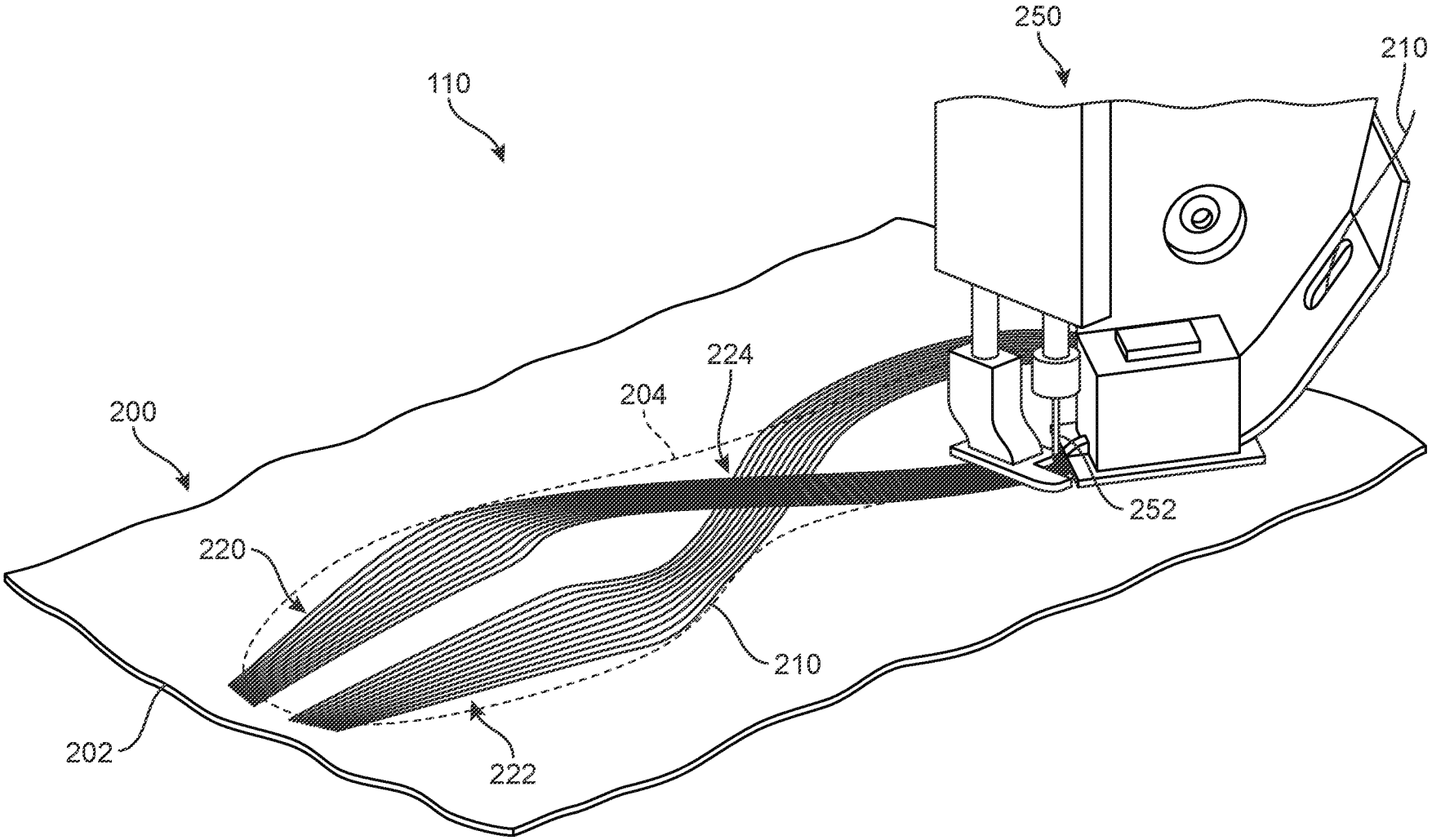
FIG. 2 is a schematic view of a step in an exemplary process for embroidering a strand to a substrate layer, according to an embodiment.

According to step 110 of process 100, a desired strand configuration is embroidered using a thread and needle to stitch a reinforcing strand to a textile element forming the substrate layer according to the desired configuration. As illustrated in FIG. 2, a first strand configuration 200 is shown. First strand configuration 200 includes a reinforcing strand 210 that is embroidered onto a substrate layer 202 by sewing reinforcing strand 210 with a needle 252 and thread 216 (shown in FIG. 3) to secure reinforcing strand 210 to substrate layer 202 according to first strand configuration 200. Thread 216 may be any form of strand, yarn, fiber filament or strand mentioned herein including materials such as PVA, EVA or TPU. Needle 252 may be a hand needle, or a machine needle. In some embodiments, the embroidery is done using an embroidery machine 250. Generally, the machine and method of embroidering can be selected from any machines and methods disclosed in the applications cited and incorporated by reference above. In some embodiments, thread 216 can be stitched around each individual strand (e.g., strand 210 and strand 214 in FIG. 3). In other embodiments, thread 216 could be stitched over a bundle of two or more threads.

Figure 16:
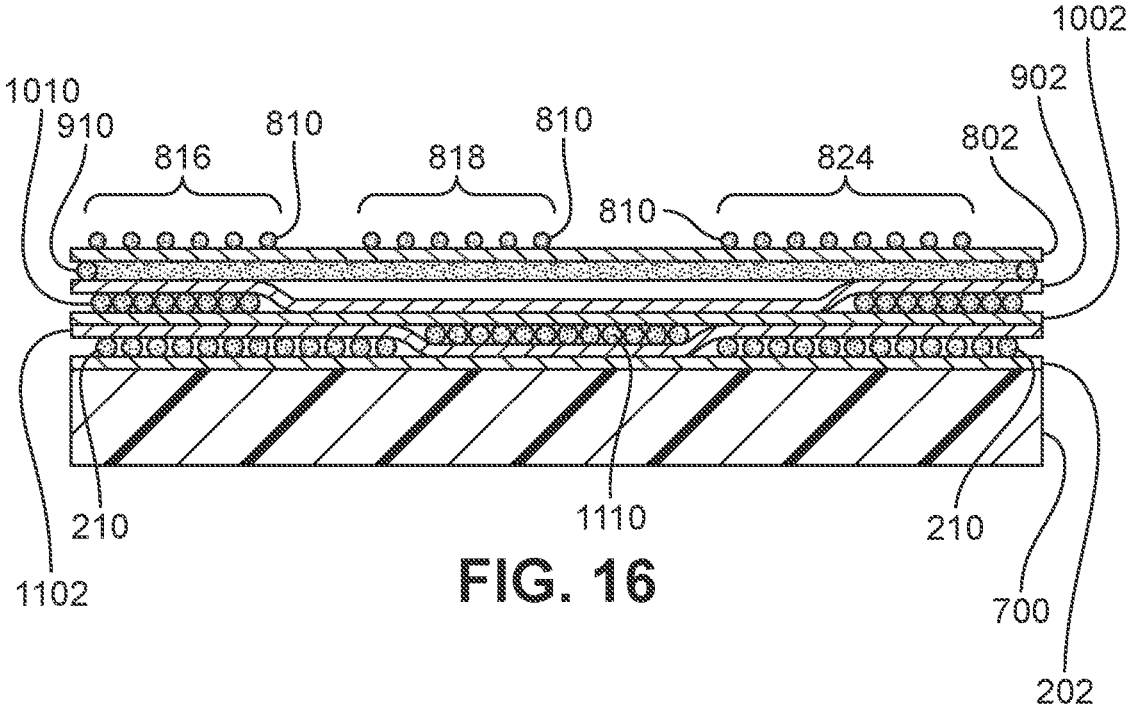
FIG. 16 is a cross section view of the reinforced plate of FIG. 14 taken along line 16-16.

For purposes of illustration, many of the figures depict groups or bundles of strands as spaced apart lines. However, it may be appreciated that in various embodiments the spacing between strand segments in these bundles of strands may vary. In some cases, strands segments could be spaced apart. As one such example, FIG. 16 depicts a cross-sectional view of an embodiment of a plate including strands arranged in a ring element 816 (see also FIG. 10). In other cases, strand segments could be very close without touching, for example being spaced apart by a distance that is less than a diameter of the reinforcing strand. In other cases, strand segments could be in contact with one another. For example, as seen in the cross-sectional view of FIG. 6, adjacent strand segments of first group of strand segments 220 touch one another as do adjacent strand segments of second group of strand segments 222. In embodiments where a reinforcing strand is made of a heat fusible material, such as a thermoplastic, the spacing between adjacent segments may be selected to ensure there is sufficient flow between strands as heat and/or pressure are applied so that the strands can be fused to one another.

Substrate layer 202 includes a perimeter outline 204 corresponding generally to a shape of a sole of an article of footwear. In some cases, perimeter outline 204 may be a visible indicium on substrate layer 202 to assist with strand placement during the embroidery process. In other cases, perimeter outline 204 may not be visible on substrate layer. In some embodiments, a strand configuration may be configured to provide longitudinal rigidity and support to a plate. In this embodiment, first strand configuration 200 includes a first group of strand segments 220 and a second group of strand segments 222 that are spaced apart from each other at one end of substrate layer 202. The strand segments of first group of strand segments 220 extend towards the opposite end of substrate layer 202 and cross over to the opposite side at a location corresponding approximately to a midfoot region. The strand segments of second group of strand segments 222 similarly extend towards the opposite end of substrate layer 202 and cross over at a similar location as first group 220. At cross-over area 224, first group of strand segments 220 and second group of strand segments 222 cross and overlap each other.

In this embodiment, first group of strand segments 220 and second group of strand segments 222 converge at cross-over area 224 and then continue to the opposite end of substrate layer 202. At the end of substrate layer 202 at a location corresponding approximately to a heel region, first group of strand segments 220 and second group of strand segments 222 form a substantially continuous loop 226. In an exemplary embodiment, first group of strand segments 220 and second group of strand segments 222 may be formed by a single reinforcing strand 210 that is continuously embroidered during the embroidering process to form first strand configuration 200. In other embodiments, reinforcing strand 210 may be cut into separate portions at various locations during the embroidering process to form first strand configuration 200.

Figure 3:
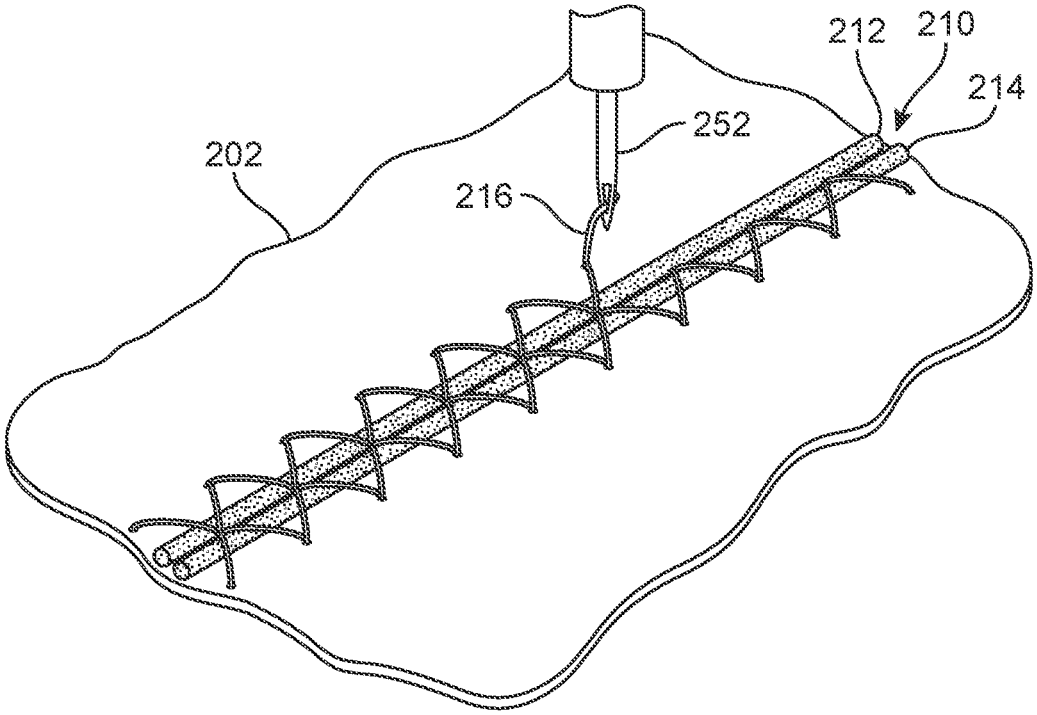
FIG. 3 is a schematic view of a close up of a step of embroidering a strand to a substrate layer, according to an embodiment.

Referring now to FIG. 3, a close up view of a portion of first strand configuration 200 is shown. During the embroidering process, an initial stitch causes needle 252 to pierce substrate layer 202 or an opening in weave of the fabric the textile forming substrate layer 202. Reinforcing strand 210 is then stitched to substrate layer 202 by machine 250 using needle 252 and thread 216, and may be secured to substrate layer 202 by a second backer stitch closing a loop of thread 216 through substrate layer 202. In this embodiment, a first strand segment 212 and a second strand segment 214 are shown stitched to substrate layer 202. In FIG. 3, first strand segment 212 and second strand segment 214 are adjacent and approximately parallel to each other. As will be described in detail below, other strand configurations can have different arrangements. In some embodiments, reinforcing strand 210 may be continuously stitched to the textile at various locations such that a single, continuous reinforcing strand 210 forms various strand segments. For example, in such embodiments, first strand segment 212 and second strand segment 214 may be continuous portions of the same reinforcing strand 210. In other embodiments, each individual strand segment may be individually stitched to the textile. For example, in such embodiments, first strand segment 212 and second strand segment 214 may not be continuous with each other and are formed by separate individual portions of reinforcing strand 210. It may be appreciated that while stitching is applied between each of the strand segments in FIG. 3, in other embodiments stitching may be applied around a bunch of adjacent segments.

The technique of embroidering the reinforcing strand to the substrate layer may vary. In some embodiments, the techniques or stitches used may include zig-zag stitch, chain stitch, double chain stitch, the buttonhole or blanket stitch, the running stitch, the satin stitch, the cross stitch, or any other stitch technique known in the art. In other embodiments, a combination of known stitch techniques may be used. In further embodiments, these techniques may be used individually or in combination to embroider either individual reinforcing strands or groups of reinforcing strands to the substrate layer. In still further embodiments, these techniques may be used individually or in combination to embroider a combination of individual reinforcing strands and groups of reinforcing strands to the substrate layer.

When the embroidering is performed by a machine, the machine may use a computer generated program to control the embroidering, including locating the reinforcing strands relative to the substrate layer, stitching the reinforcing strands to the substrate layer, as well as which strands to feed, which stitches to use to secure the strands, and the overall layout and strand configuration for a particular embodiment. In some embodiments, the thread may continuously secure the reinforcing strands or strand segments along most or all of the strand configuration. In other embodiments, the thread securing the reinforcing strands or strand segments may be discontinuous between individual strands or strand segments within the strand configuration.

Threads used for embroidery may be used from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymers materials and may include nitrile rubber. Thread may be also made from more conventional materials including cotton, silk, or other natural fibers disclosed herein. Thread may also be made from any known synthetic equivalent. In some embodiments, exposing the thread to heat or pressure may cause the thread to melt or fuse. In other embodiments, exposing the thread to heat or pressure may cause the thread to dissolve. In still other embodiments, the thread may dissolve when exposed to a solvent, such as acid or water.

It may be appreciated that embroidery is only one method for attaching reinforcing strands to a substrate layer and other embodiments could use other methods of temporary and/or permanent attachment. These methods may include, but are not limited to: adhesives, heat welding, tacking, as well as other methods known in the art for temporarily or permanently securing strands to a substrate or backer layer.

Figure 4:
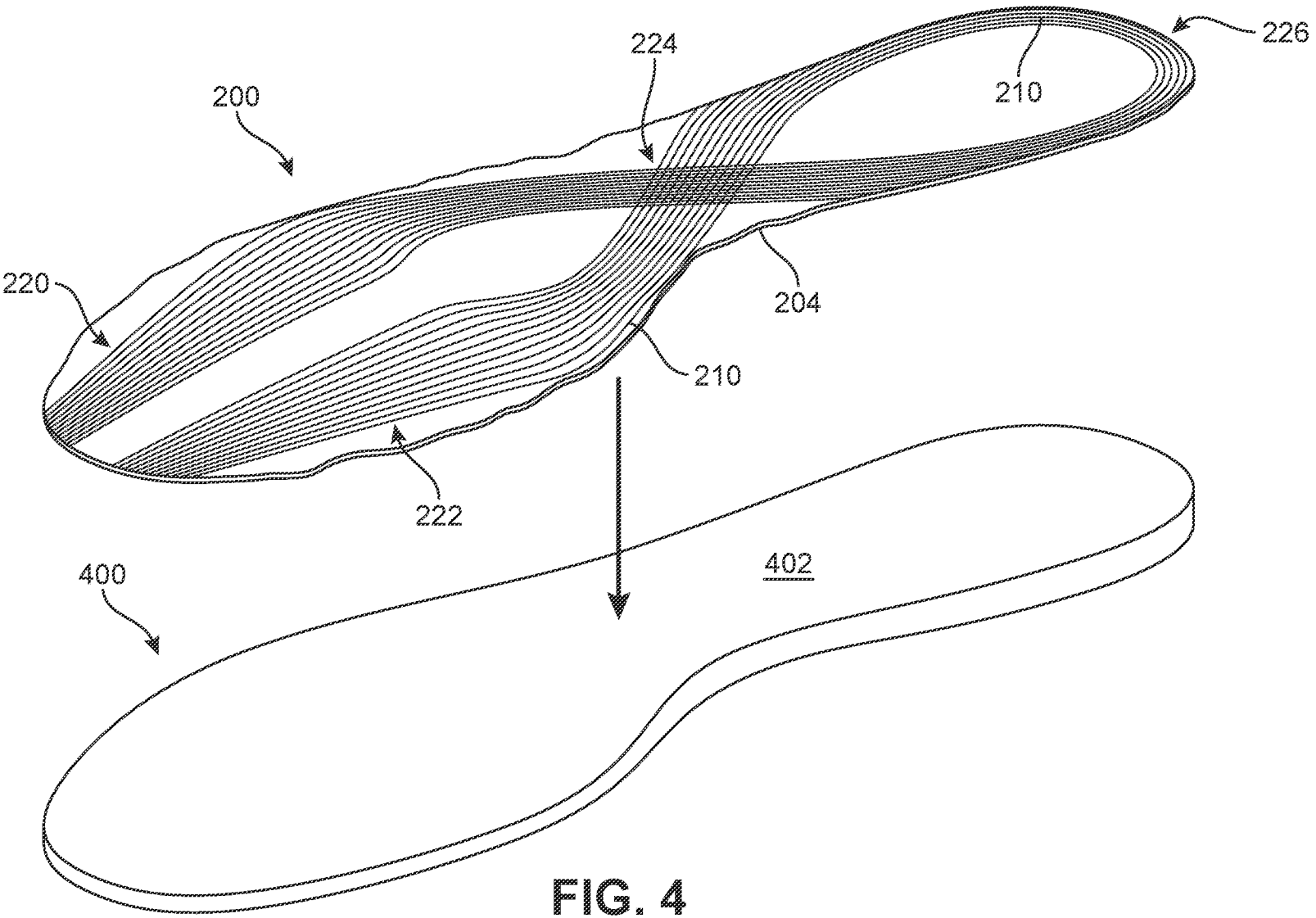
FIG. 4 is a schematic view of a step in an exemplary process for joining an embroidered substrate layer to a plate, according to an embodiment.

In some embodiments, once the strand configuration is embroidered onto the substrate layer, the strand configuration can be removed from the surrounding material of the substrate layer. For example, in an exemplary embodiment, first strand configuration 200 can be removed from the surrounding material of substrate layer 202 along perimeter outline 204. FIG. 4 illustrates an exemplary embodiment of first strand configuration 200 disposed on substrate layer 202 that has been removed from the surrounding material along perimeter outline 204. In this embodiment, substrate layer 202 including first strand configuration 200 is arranged relative to a base plate 400, in accordance with step 120 of exemplary method 100.

In this embodiment, the shape formed by perimeter outline 204 of substrate layer 202 approximately corresponds with the shape of base plate 400. Substrate layer 202 including first strand configuration 200 is arranged so that a back side of substrate layer 202 opposite a top side of substrate layer 202 having reinforcing strand 210 is disposed facing towards a top surface 402 of base plate 400. With this arrangement, the back side of substrate layer 202 can be bonded or joined to top surface 402 of base plate 400.

Figure 5:
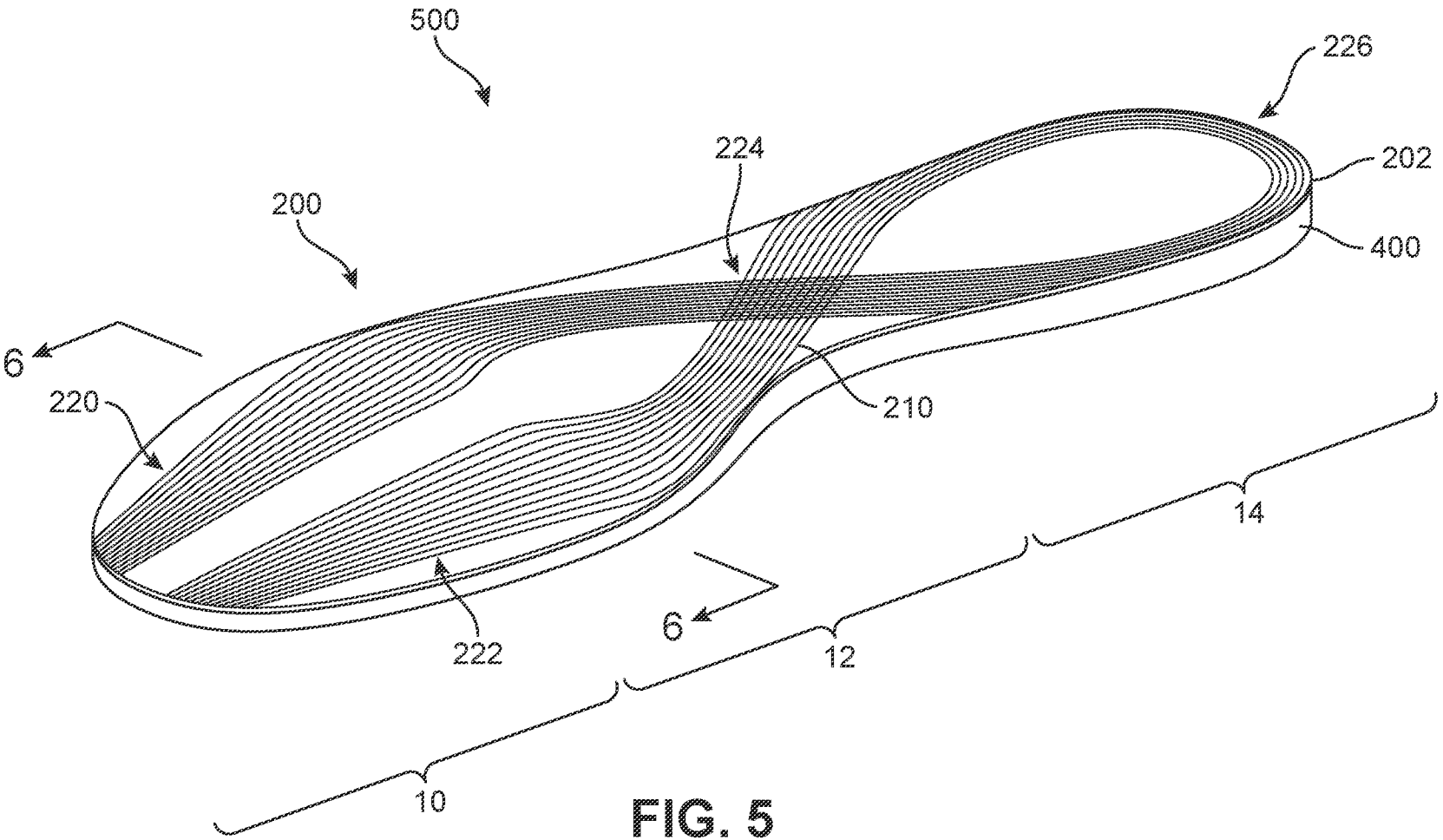
FIG. 5 is a schematic isometric view of an exemplary embodiment of a reinforced plate.

Referring now to FIG. 5, substrate layer 202 including first strand configuration 200 has been bonded to base plate 400, in accordance with step 130 of exemplary method 100, to form a fiber reinforced plate 500. In this embodiment, fiber reinforced plate 500 includes a forefoot region 10, a midfoot region 12, and a heel region 14. First strand configuration 200 of fiber reinforced plate 500 includes first group of strand segments 220 and second group of strand segments 222 disposed within forefoot region 10. First group of strand segments 220 and second group of strand segments 222 converge at cross-over area 224 disposed within midfoot region 12 and then continue longitudinally along fiber reinforced plate 500 to heel region 14 where they form substantially continuous loop 226. With this arrangement, first strand configuration 200 provides fiber reinforced plate 500 with selected strength and stability at various locations within forefoot region 10, midfoot region 12, and heel region 14.

Figure 6:
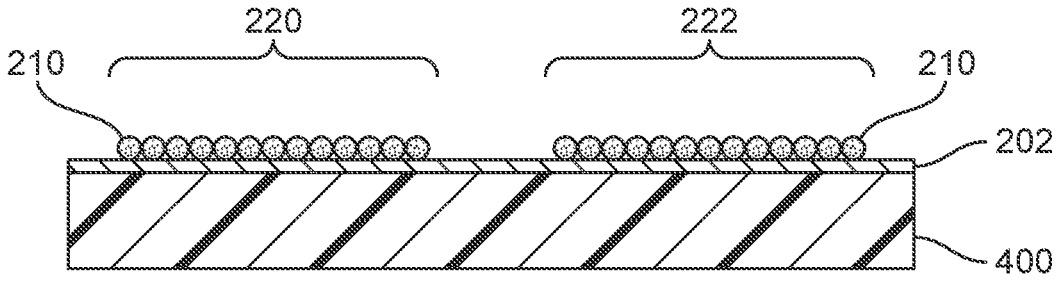
FIG. 6 is a cross section view of the reinforced plate of FIG. 5 taken along line 6-6.

FIG. 6 illustrates a cross-section view of fiber reinforced plate 500 taken along line 6-6 in FIG. 5. As shown in FIG. 6, substrate layer 202 is bonded to base plate 400 on one side and reinforcing strand 210 is disposed on the opposite side of substrate layer 202. According to first strand configuration 200, reinforcing strand 210 is arranged into first group of strand segments 220 and second group of strand segments 222 within forefoot region 10 of fiber reinforced plate 500. As can be seen in FIG. 6, the strands of first group of strand segments 220 are in contact with one another and the strands of second group of strand segments 222 are in contact with one another. A gap is disposed between first group of strand segments 220 and second group of strand segments 222.

In some embodiments where a reinforcing strand is comprised of a material including a heat fusible material, heat and/or pressure can be applied to fuse adjacent strand segments. In some cases, where a substrate layer may also be comprised of a heat fusible material (e.g., TPU), the application of heat and/or pressure can be used to fuse a reinforcing strand to the substrate layer.

Figure 7:
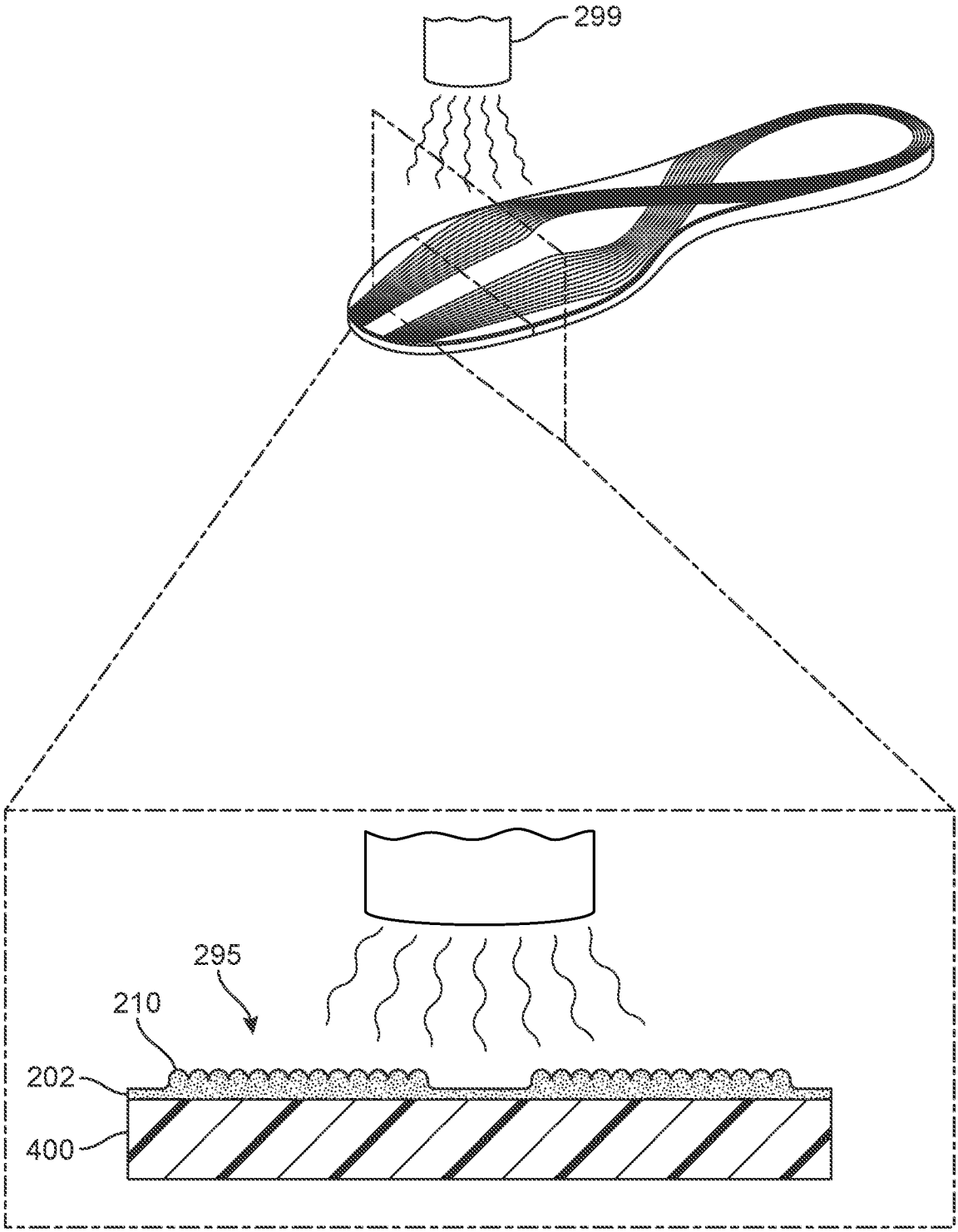
FIG. 7 is a schematic view of a step of applying heat to a substrate layer and reinforcing strands, according to an embodiment.

FIG. 7 is a schematic view of a step in a process for fusing reinforcing strand segments to one another and to a substrate layer. In this case, an external heat source 299 is depicted, though in other cases pressure could also be used (e.g., by placing the layers in a heated press). Referring to the enlarged cross-sectional view of FIG. 7, the application of heat acts to melt reinforcing strand 210 and substrate layer 202. Specifically, adjacent segments of reinforcing strand 210 have been fused together with substrate layer 202 into a single reinforcing element 295, which is disposed on base plate 400.

In other embodiments, a substrate layer may not be heat fusible (e.g., may comprise a textile material). In such embodiments, the adjacent segments of the reinforcing strand may fuse into a reinforcing element but may remain attached to the substrate via stitching. Furthermore, in other embodiments, base plate 400 could be optional and a reinforced plate may be formed by heat fusing only a substrate layer with one or more reinforcing strands arranged in strand configuration. In still other embodiments, base plate 400 could also be made of a heat fusible material (e.g., TPU) and so could fuse with substrate 202 under the application of heat and/or pressure.

Figure 8:
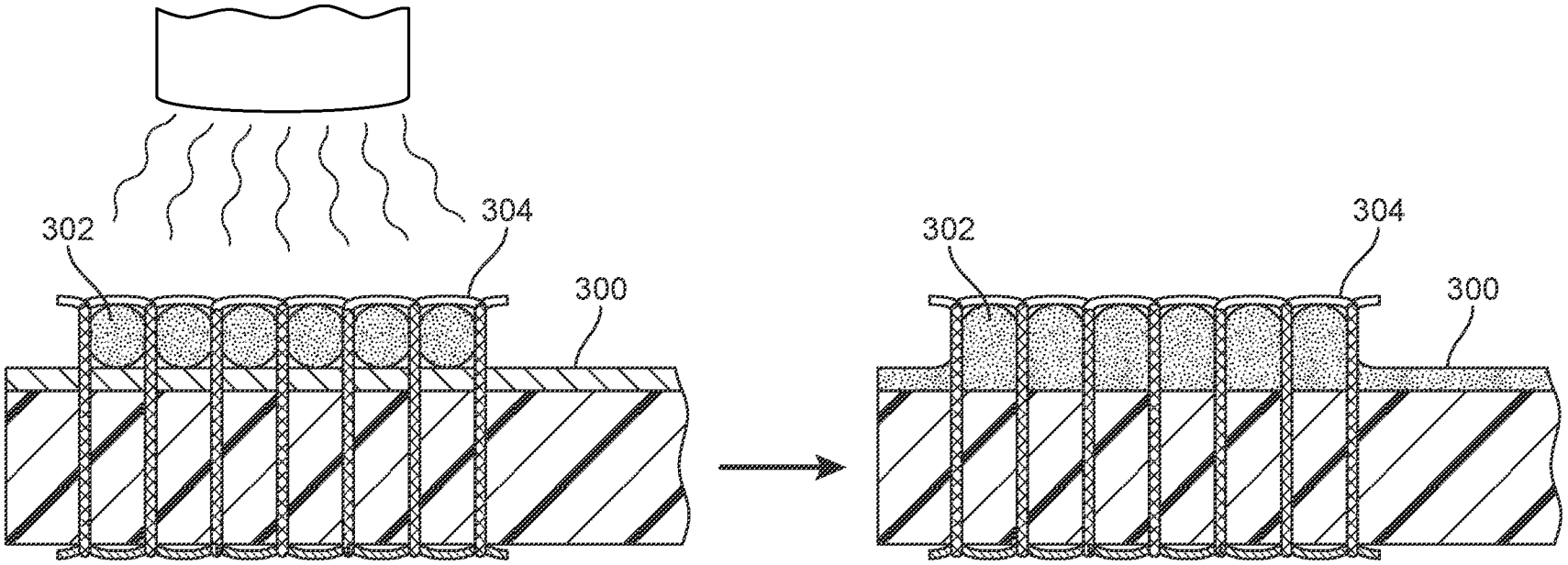
FIG. 8 is a schematic view of an embodiment of heating a substrate layer and reinforcing strands along with a non-fusible thread.

In some embodiments, a thread used for embroidering a reinforcing strand to a substrate layer could optionally be heat fusible (e.g., made of TPU). In such embodiments, as heat and/or pressure are applied the embroidery thread may fuse with the reinforcing strand and/or the substrate layer. However, in other embodiments, a thread may not be heat fusible. FIG. 8 depicts a schematic view of a cross-sectional segment of a plate with a non-fusible thread. As heat is applied substrate layer 300 fuses with strand segments 302 but non-fusible thread 304 remains separate from these structures. This arrangement may allow for improved aesthetics by using threads with distinct colors that remain visibly distinct from the fused threads and substrate after heat and/or pressure have been applied.

The previous embodiment depicts bonding one substrate layer with a strand configuration to a base plate, however it may be appreciated that exemplary method 100 could be used to bond any number of substrate layers containing different strand configurations to a base plate. Moreover, this method could be used to bond substrate layers to each other, for example, by using a material for substrate layers that facilitates bonding, such as TPU. Accordingly, a variety of different substrate layers having various strand configurations can be bonded together to form a fiber reinforced plate.

Referring now to FIGS. 9 through 17, an embodiment of a fiber reinforced plate having multiple embroidered substrate layers with strand configurations is illustrated. FIGS. 9-17 and the following description discuss the arrangement of multiple substrate layers with strand configurations bonded to a base plate in a particular order by way of example. It should be understood that the order of each individual substrate layer and strand configuration can vary as desired to form the fiber reinforced base plate with multiple embroidered substrate layers.

Figure 9:
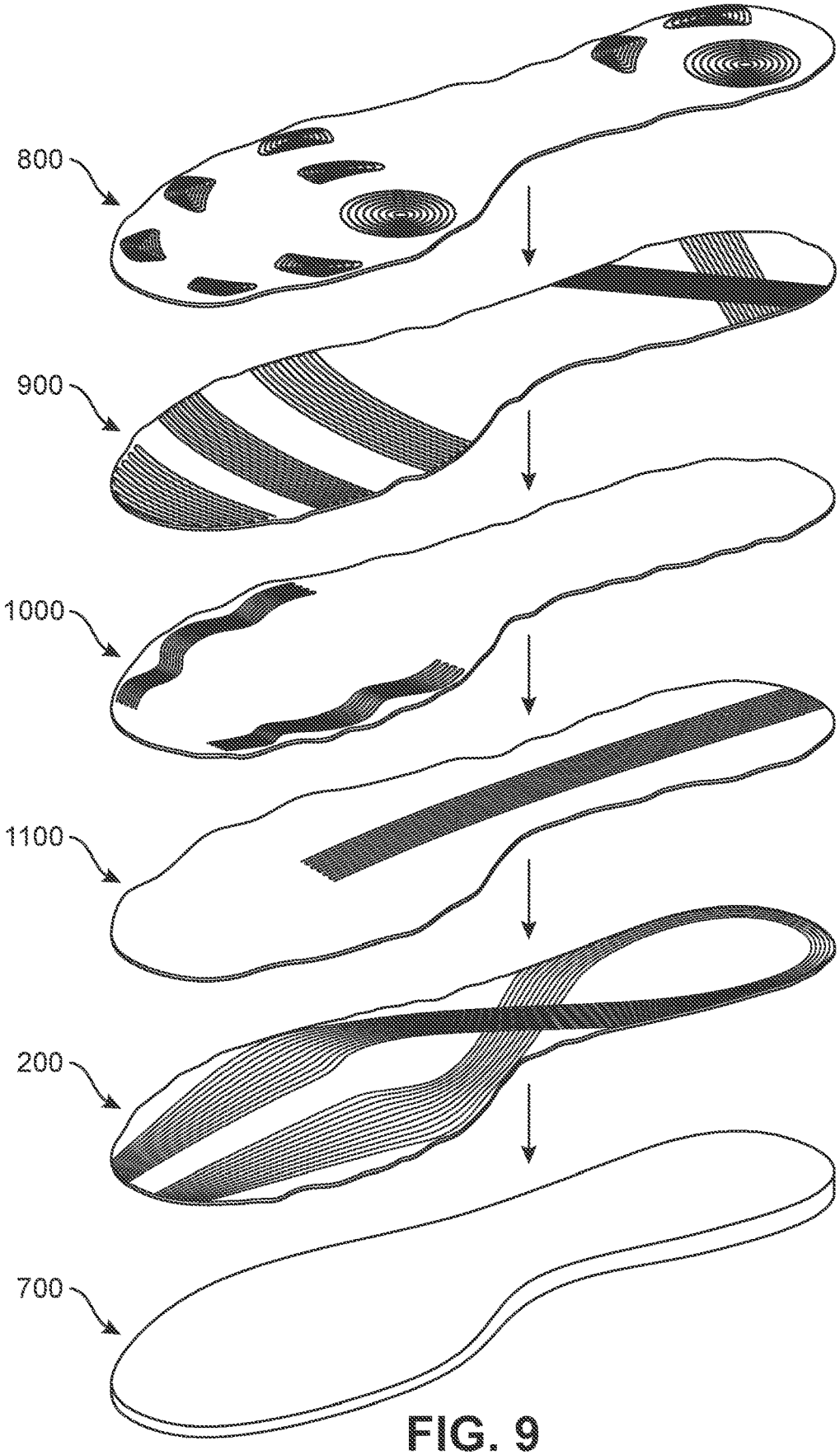
FIG. 9 is an exploded schematic view of a step in a process for forming a reinforced plate using multiple embroidered substrate layers, according to an embodiment.

Referring now to FIG. 9, multiple embroidered substrate layers with strand configurations are shown in relation to a base plate 700. Each of the embroidered substrate layers includes a corresponding with strand configuration disposed on the substrate layer. Strand configurations on the substrate layers may be formed in a similar manner as described above with reference to first strand configuration 200 on substrate layer 202. In this embodiment, the multiple embroidered substrate layers that will form the fiber reinforced plate include substrate layers with first strand configuration 200, described above, as well as substrate layers including a second strand configuration 800, a third strand configuration 900, a fourth strand configuration 1000, and a fifth strand configuration 1100. Each of the strand configurations is associated with a separate substrate layer configured to be bonded together with base plate 700. In other embodiments, however, multiple strand configurations may be disposed on a single substrate layer.

Figure 10:
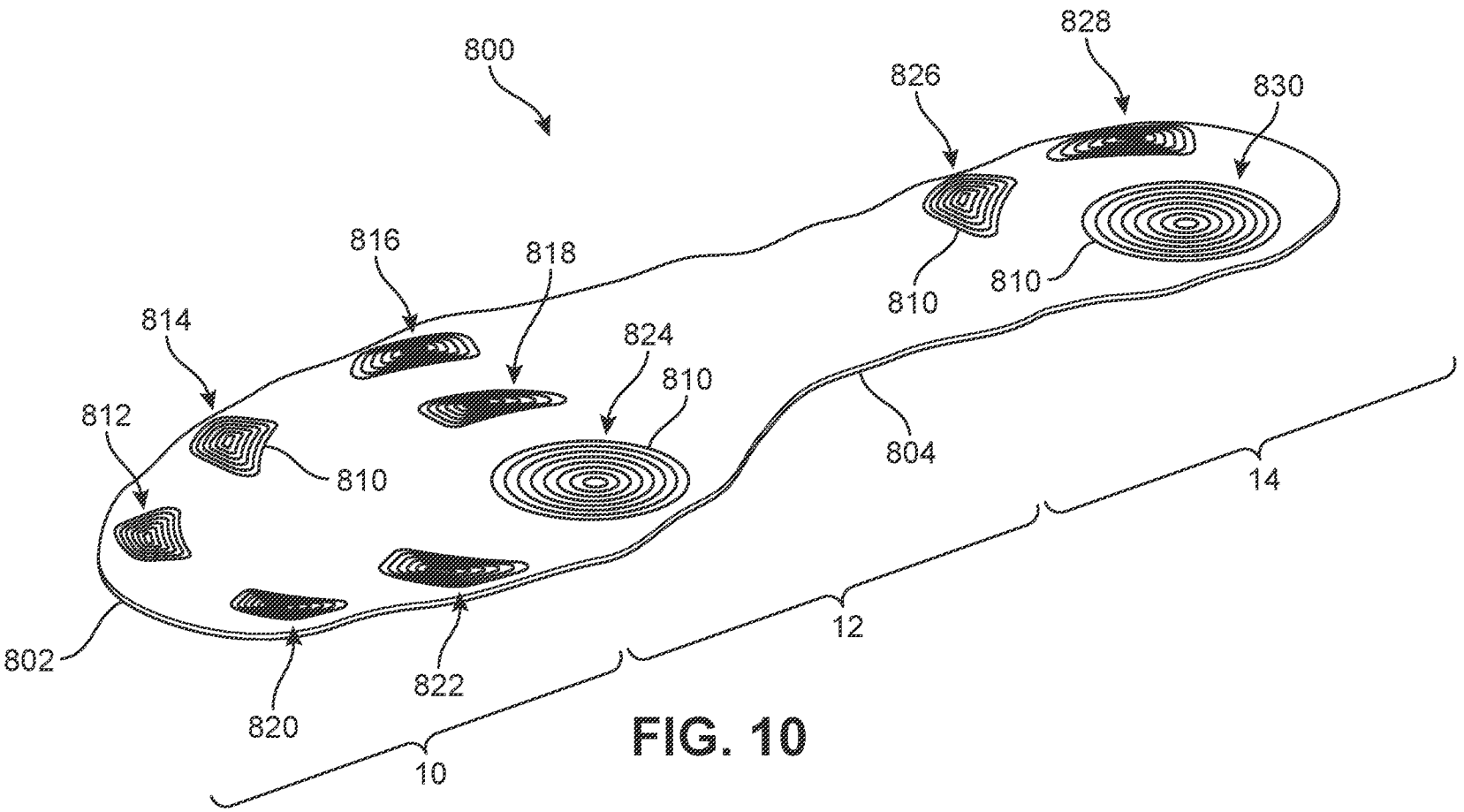
FIG. 10 is a schematic isometric view of an exemplary embodiment of an embroidered substrate layer.

FIG. 10 illustrates second strand configuration 800 in detail. In this embodiment, second strand configuration 800 includes a plurality of separate ringed elements formed by a reinforcing strand 810 that is embroidered onto a substrate layer 802. Substrate layer 802 including second strand configuration 800 has a shape defined by an outer perimeter 804 that approximately corresponds with the sole shape of base plate 700. As shown in FIG. 10, the plurality of ringed elements are disposed across various portions of substrate layer 802, including at least in portions of forefoot region 10 and/or heel region 14. In addition, in some embodiments, ringed elements may also be disposed in a portion of midfoot region 12.

Each ringed element is formed by concentric rings of reinforcing strand 810 embroidered onto substrate layer 802. The rings are spaced apart from each other such that they do not intersect. In this embodiment, the plurality of ringed elements of second strand configuration 800 include a first ringed element 812, a second ringed element 814, a third ringed element 816, a fourth ringed element 818, a fifth ringed element 820, a sixth ringed element 822, a seventh ringed element 824, an eighth ringed element 826, a ninth ringed element 828, and a tenth ringed element 830. As shown in FIG. 10, first ringed element 812, second ringed element 814, third ringed element 816, fourth ringed element 818, fifth ringed element 820, sixth ringed element 822, and seventh ringed element 824 are generally disposed in forefoot region 10 and/or midfoot region 12. Eighth ringed element 826, ninth ringed element 828, and tenth ringed element 830 are generally disposed in heel region 14.

In an exemplary embodiment, the location of each ringed element may correspond with the location of a cleat or stud that will be associated with the reinforced plate and/or sole assembly. With this arrangement, the plurality of ringed elements of second strand configuration 800 can assist with providing additional strength and support to cleats or studs of a reinforced plate and/or sole assembly of an article of footwear.

Additionally, in various embodiments, some of the ringed elements can have different shapes. For example, in this embodiment, seventh ringed element 824 and tenth ringed element 830 have an approximately circular shape formed by concentric circles of reinforcing strand 810 having different sizes. Other ringed elements have different shapes. For example, in this embodiment, first ringed element 812, second ringed element 814, third ringed element 816, fourth ringed element 818, fifth ringed element 820, sixth ringed element 822, seventh ringed element 824, eighth ringed element 826, and ninth ringed element 828 have approximately trapezoidal or wedge shapes formed by concentric segments of reinforcing strand 810 having different sizes.

In some cases, the shape of ringed elements may be selected to correspond with the associated shape of the cleat or stud that will be associated with the reinforced plate and/or sole assembly at that location. For example, the approximately circular shape of seventh ringed element 824 and tenth ringed element 830 may be associated with a circular stud or cleat. Similarly, the approximately trapezoidal or wedge shapes of first ringed element 812, second ringed element 814, third ringed element 816, fourth ringed element 818, fifth ringed element 820, sixth ringed element 822, seventh ringed element 824, eighth ringed element 826, and ninth ringed element 828 may be associated with an approximately trapezoidal or wedge shaped cleat or stud.

Figure 11:
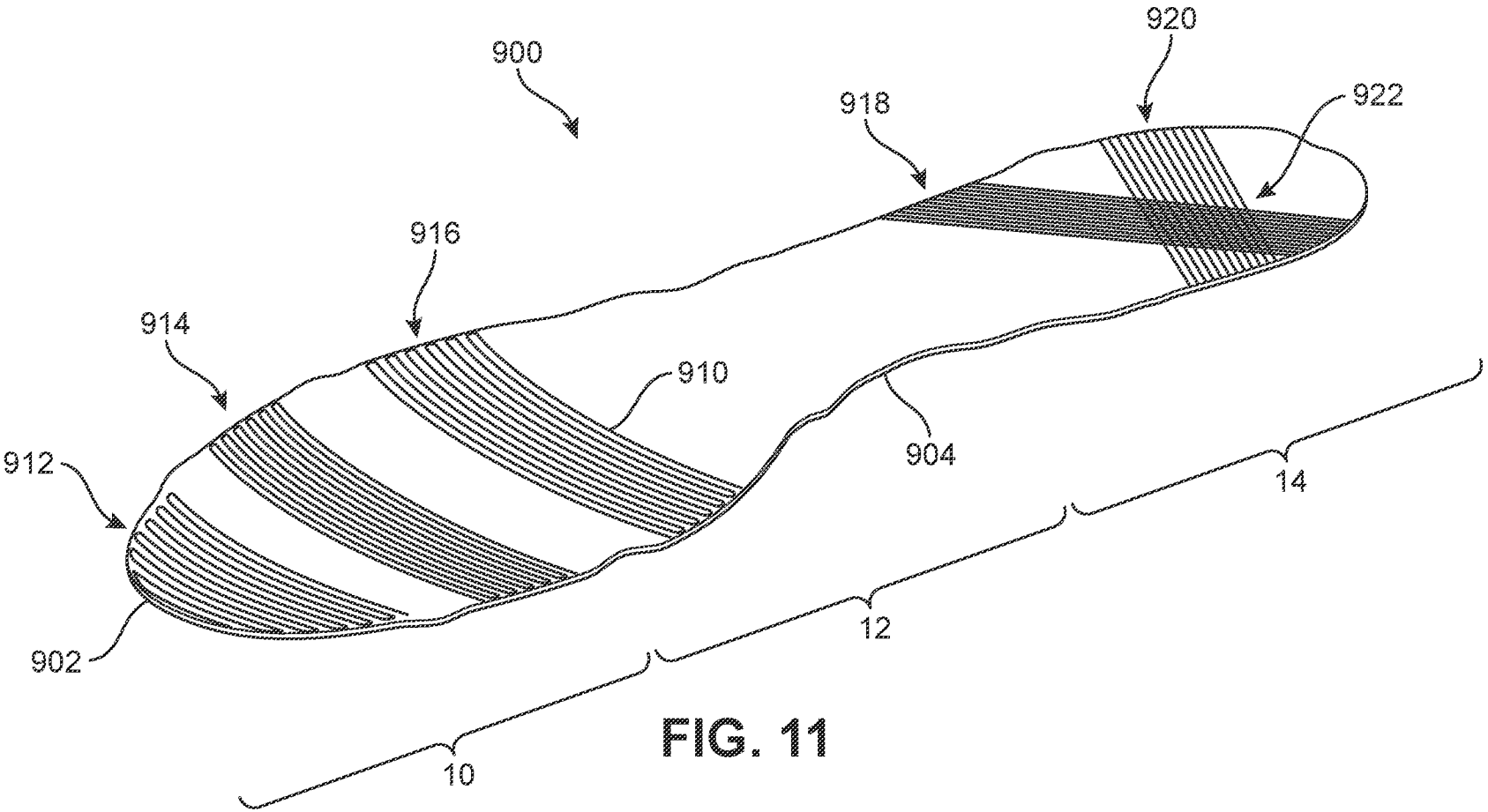
FIG. 11 is a schematic isometric view of another exemplary embodiment of an embroidered substrate layer.

FIG. 11 illustrates third strand configuration 900 in detail. In this embodiment, third strand configuration 900 includes a plurality of separate strand groups formed by a reinforcing strand 910 that is embroidered onto a substrate layer 902. Substrate layer 902 including third strand configuration 900 has a shape defined by an outer perimeter 904 that approximately corresponds with the sole shape of base plate 700. As shown in FIG. 11, the plurality of strand groups are disposed across various portions of substrate layer 902, including at least in portions of forefoot region 10 and/or heel region 14. In addition, in some embodiments, strand groups may also be disposed in a portion of midfoot region 12.

In this embodiment, each strand group of the plurality of strand groups is disposed in a generally lateral direction across substrate layer 902. The plurality of strand groups of third strand configuration 900 includes a first strand group 912, a second strand group 914, a third strand group 916, a fourth strand group 918, and a fifth strand group 920. As shown in FIG. 11, first strand group 912 is disposed near the front edge of substrate layer 902 in forefoot region 10. Second strand group 914 is disposed rearward of first strand group 912 in forefoot region 10 and is spaced apart from first strand group 912. Similarly, third strand group 916 is disposed rearward of second strand group 914 in a portion of forefoot region 10 and/or a portion of midfoot region 12 and is spaced apart from first strand group 912 and second strand group 914. In this embodiment, first strand group 912, second strand group 914, and third strand group 916 extend approximately laterally between opposite lateral and medial sides of substrate layer 902. With this arrangement, first strand group 912, second strand group 914, and third strand group 916 of third strand configuration 900 can assist with providing additional strength and support to across a lateral direction of a reinforced plate and/or sole assembly of an article of footwear.

As shown in FIG. 11, fourth strand group 918 and fifth strand group 920 are disposed in heel region 14. In this embodiment, fourth strand group 918 and fifth strand group 920 extend laterally between opposite lateral and medial sides of substrate layer 902 and also are angled relative to the lateral direction of substrate layer 902. With this angled arrangement, the segments of reinforcing strand 910 forming fourth strand group 918 and fifth strand group 920 intersect and cross over each other at cross-over area 922. Such an arrangement of third strand configuration 900 with angled fourth strand group 918 and fifth strand group 920, and including overlapping strands at cross-over area 922, can assist with providing additional strength and support to a heel region of a reinforced plate and/or sole assembly of an article of footwear.

In an exemplary embodiment, first strand group 912, second strand group 914, third strand group 916, fourth strand group 918, and fifth strand group 920 of third strand configuration 900 each may be formed by a single strand segment of reinforcing strand 910 that repeatedly extends back and forth in the lateral direction on substrate layer 902 to form the individual strand group. That is, a single, continuous segment of reinforcing strand 910 may be used to form each strand group. In other embodiments, reinforcing strand 910 may be cut into separate portions at various locations during the embroidering process to form each strand group of third strand configuration 900.

Figure 12:
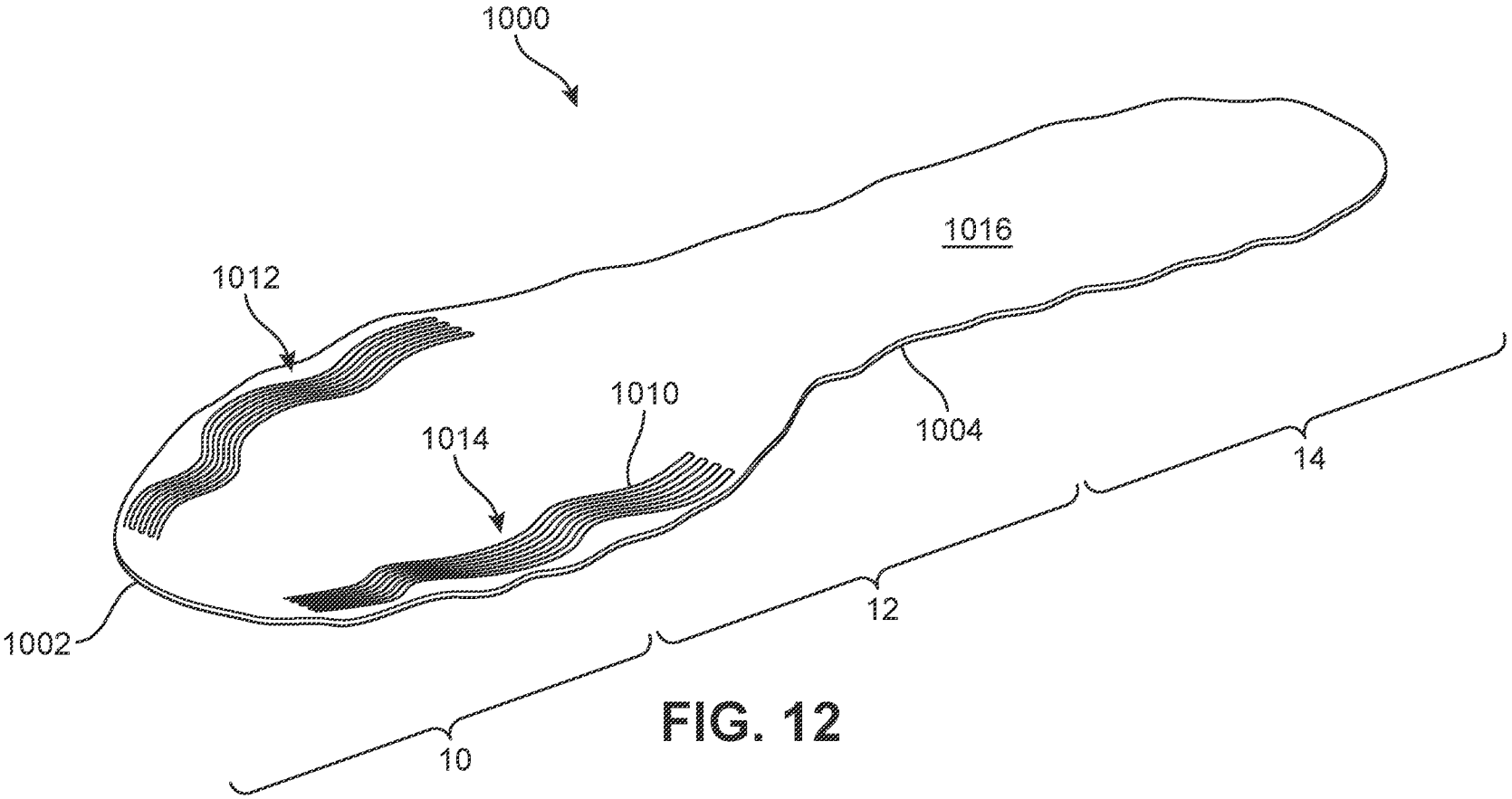
FIG. 12 is a schematic isometric view of another exemplary embodiment of an embroidered substrate layer.

FIG. 12 illustrates fourth strand configuration 1000 in detail. In this embodiment, fourth strand configuration 1000 includes two separate strand groups formed by a reinforcing strand 1010 that is embroidered onto a substrate layer 1002. Substrate layer 1002 including fourth strand configuration 1000 has a shape defined by an outer perimeter 1004 that approximately corresponds with the sole shape of base plate 700. As shown in FIG. 12, the two strand groups are disposed near or adjacent to the lateral and medial outside edges of outer perimeter 1004 of substrate layer 1002 in forefoot region 10.

In this embodiment, each of the separate strand groups extends approximately longitudinally along substrate layer 1002 towards the front edge of outer perimeter 1004 of substrate layer 1002 at forefoot region 10. The two strand groups include a first strand group 1012 and a second strand group 1014. First strand group 1012 and second strand group 1014 are spaced apart from each other on opposite sides of forefoot region 10 of substrate layer 1002. Additionally, each of first strand group 1012 and second strand group 1014 has a generally wavy or undulating shape formed by approximately parallel segments of reinforcing strand 1010.

In an exemplary embodiment, fourth strand configuration 1000 may correspond with cleat and/or stud locations to further provide support and stability at locations on a reinforced plate and/or sole assembly of an article of footwear. Substrate layer 1002 includes a blank area 1016 extending through midfoot region 12 and heel region 14 that has not been embroidered and is free of reinforcing strand 1010. In this embodiment, substrate layer 1002 includes blank area 1016 such that substrate layer 1002 extends fully to the end of heel region 14. Providing a substrate layer with blank areas that are not embroidered so that the substrate layer is similarly shaped and sized as other substrate layers may assist with arrangement of the substrate layers for bonding with base plate 700. In other embodiments, however, blank area 1016 may be omitted since it is not embroidered and does not include reinforcing strand 1010.

In an exemplary embodiment, first strand group 1012 and second strand group 1014 each may be formed by a single strand segment of reinforcing strand 1010 that repeatedly extends back and forth in the longitudinal direction on substrate layer 1002 to form the individual strand group. That is, a single, continuous segment of reinforcing strand 1010 may be used to form each strand group. In other embodiments, reinforcing strand 1010 may be cut into separate portions at various locations during the embroidering process to form each strand group of fourth strand configuration 1000.

Figure 13:
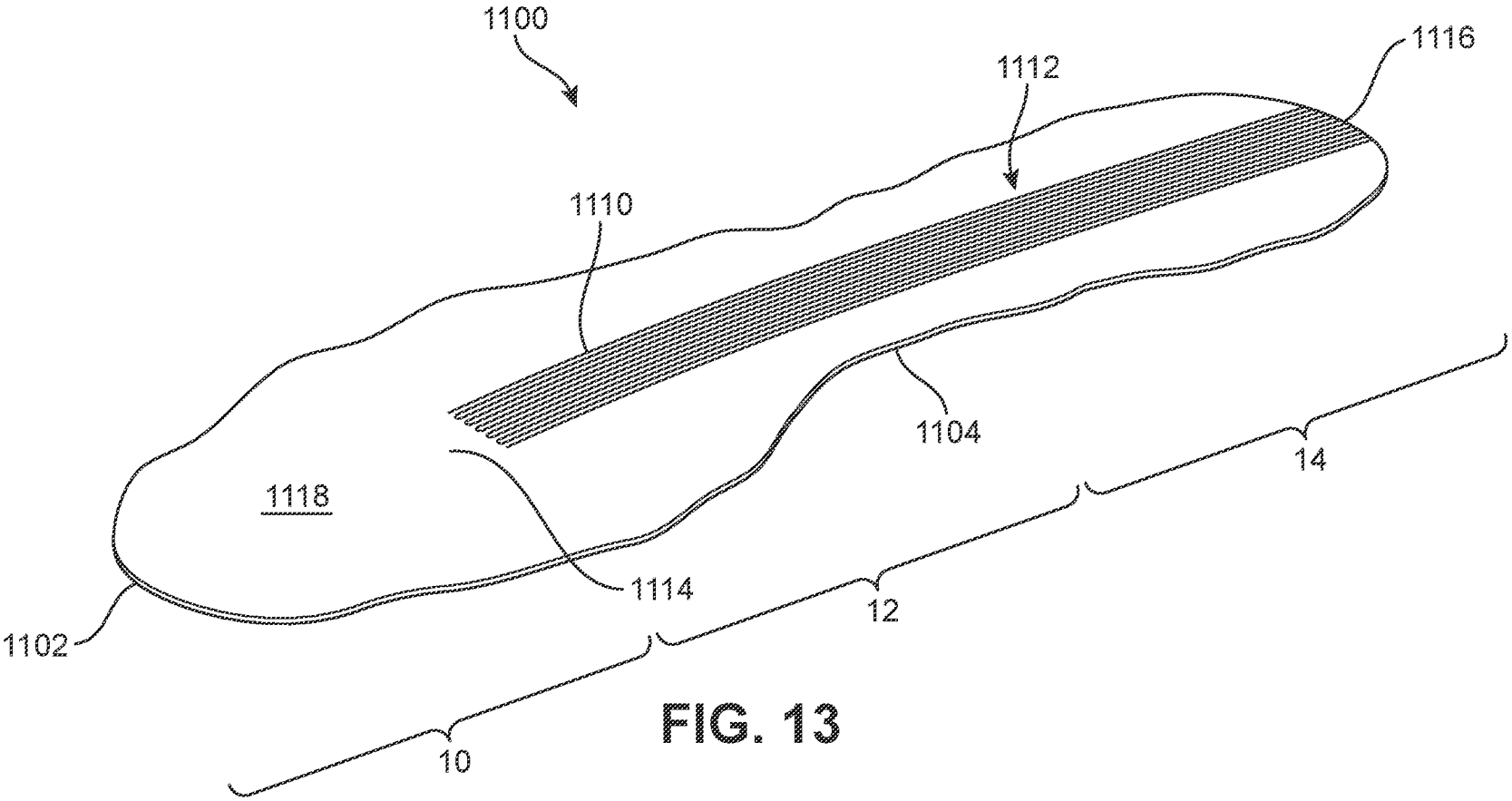
FIG. 13 is a schematic isometric view of another exemplary embodiment of an embroidered substrate layer.

FIG. 13 illustrates fifth strand configuration 1100 in detail. In this embodiment, fifth strand configuration 1100 includes a single strand group 1112 formed by a reinforcing strand 1110 that is embroidered onto a substrate layer 1102. Substrate layer 1102 including fifth strand configuration 1100 has a shape defined by an outer perimeter 1104 that approximately corresponds with the sole shape of base plate 700. As shown in FIG. 13, strand group 1112 is approximately centrally located along a middle of substrate layer 1102 extending in a longitudinal direction from a first end 1114 starting at least in a portion of midfoot region 12 and terminating at a second end 1114 in heel region 14. With this arrangement, fifth strand configuration can provides additional support and stability along a central spine or axis a reinforced plate and/or sole assembly of an article of footwear.

As shown in FIG. 13, substrate layer 1102 includes a blank area 1118 extending through at least a portion of forefoot region 10 that has not been embroidered and is free of reinforcing strand 1110. In this embodiment, substrate layer 1102 includes blank area 1118 such that substrate layer 1102 extends fully to the front end of forefoot region 10. Providing a substrate layer with blank areas that are not embroidered so that the substrate layer is similarly shaped and sized as other substrate layers may assist with arrangement of the substrate layers for bonding with base plate 700. In other embodiments, however, blank area 1118 may be omitted since it is not embroidered and does not include reinforcing strand 1110.

In an exemplary embodiment, strand group 1112 may be formed by a single strand segment of reinforcing strand 1110 that repeatedly extends back and forth in the longitudinal direction on substrate layer 1102 to form the strand group. That is, a single, continuous segment of reinforcing strand 1110 may be used to form the strand group. In other embodiments, reinforcing strand 1110 may be cut into separate portions at various locations during the embroidering process to form strand group 1112 of fifth strand configuration 1100.

Figure 14:
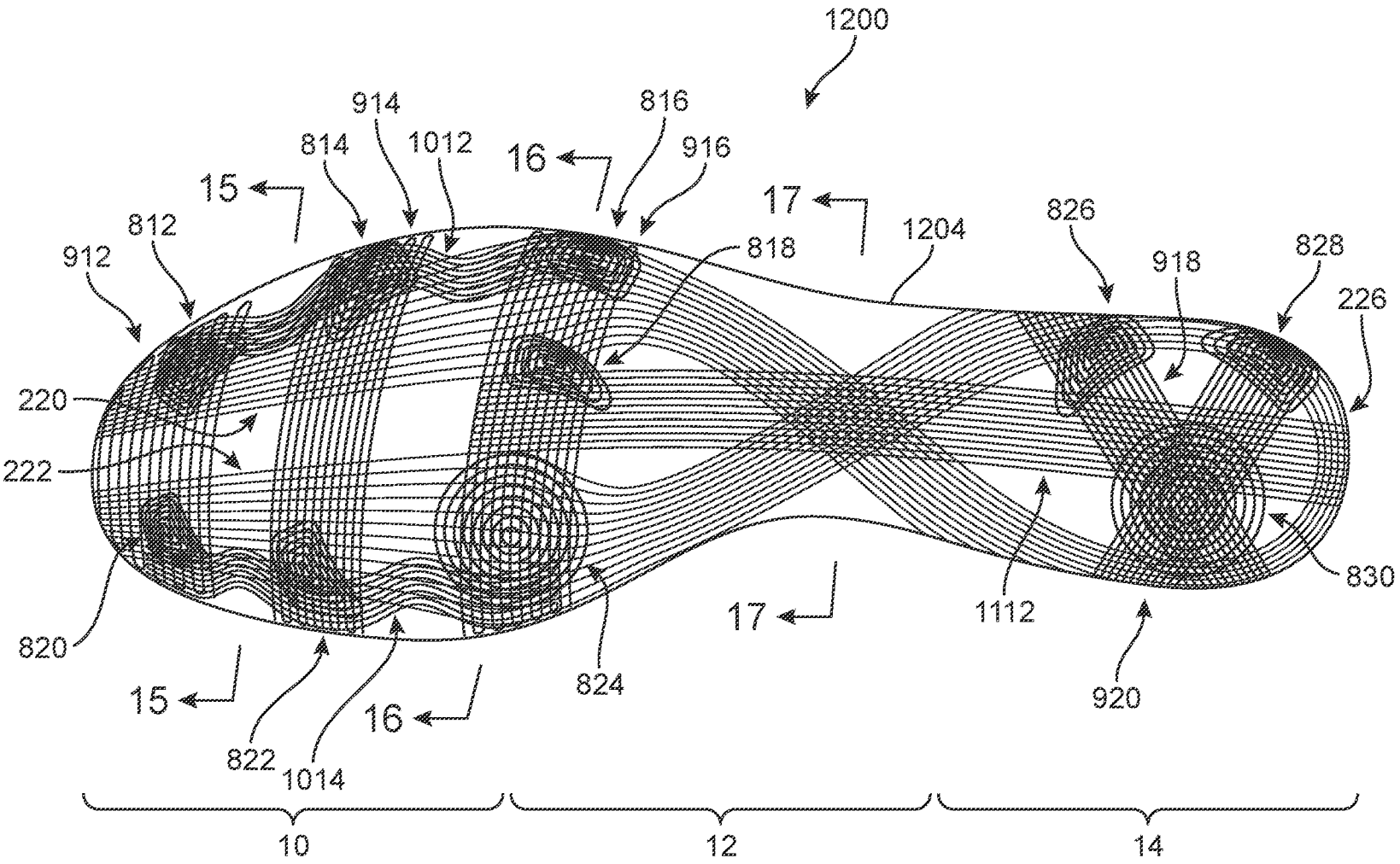
FIG. 14 is a schematic top view of an exemplary embodiment of a reinforced plate for an article of footwear including multiple embroidered substrate layers.

FIG. 14 illustrates an exemplary embodiment of a fiber reinforced plate 1200 formed by multiple substrate layers having different strand configurations. In this embodiment, reinforced plate 1200 includes substrate layer 202 having first strand configuration 200, substrate layer 802 having second strand configuration 800, substrate layer 902 having third strand configuration 900, substrate layer 1002 having fourth strand configuration 1000, and substrate layer 1102 having fifth strand configuration 1100 that have been bonded together with base plate 700. Reinforced plate 1200 is generally sole-shaped defined by an outer perimeter 1204.

Figure 15:
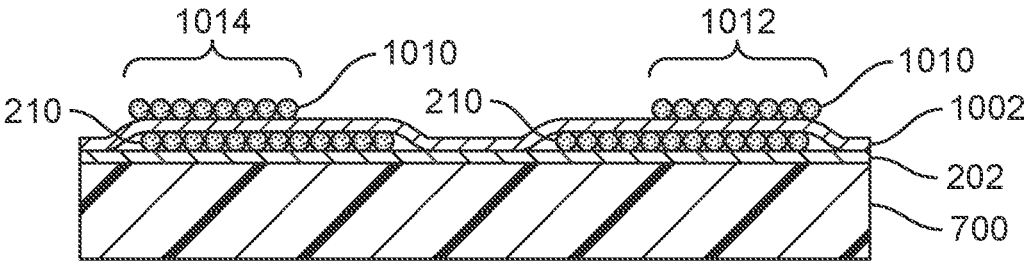
FIG. 15 is a cross section view of the reinforced plate of FIG. 14 taken along line 15-15.
Figure 17:
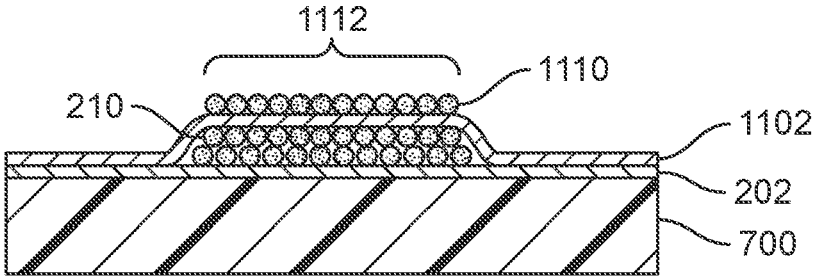
FIG. 17 is a cross section view of the reinforced plate of FIG. 14 taken along line 17-17.

FIGS. 15 through 17 illustrate various cross-sectional views of reinforced plate 1200 taken along the lines shown in FIG. 14 to show the layered arrangement of the multiple substrate layers having different strand configurations at various locations. It should be noted that blank areas of substrate layers (i.e., areas not embroidered or not including a reinforcing strand) have been omitted from the cross-sectional views shown in FIGS. 15-17.

FIG. 15 illustrates a cross-section of reinforced plate 1200 taken across a lateral direction in forefoot region 10 along line 15-15. As shown in FIG. 15, substrate layer 202 including first strand configuration 200 is bonded to base plate 700 on one side and reinforcing strand 210 is disposed on the opposite side of substrate layer 202. According to first strand configuration 200, reinforcing strand 210 is arranged into first group of strand segments 220 and second group of strand segments 222 within forefoot region 10 of fiber reinforced plate 1200. As can be seen in FIG. 15, the strands of first group of strand segments 220 are located closely together and the strands of second group of strand segments 222 are also located closely together. A gap is disposed between first group of strand segments 220 and second group of strand segments 222.

In this embodiment, substrate layer 1002 including fourth strand configuration 1000 also bonded to base plate 700 and is disposed above substrate layer 202 including first strand configuration 200. According to fourth strand configuration 1000, reinforcing strand 1010 is arranged into first strand group 1012 and second strand group 1014 within forefoot region 10 of fiber reinforced plate 1200. As can be seen in FIG. 15, the strands of first strand group 1012 and are located closely together and the strands of second strand group 1014 are also located closely together. A gap is disposed between first strand group 1012 and second strand group 1014.

As shown in FIG. 15, the arrangement of substrate layer 1002 including fourth strand configuration 1000 and substrate layer 202 including first strand configuration 200 forefoot region 10 of fiber reinforced plate 1200 is such that the strands of first group of strand segments 220 of first strand configuration 200 are disposed beneath the strands of first strand group 1012 of fourth strand configuration 1000. Similarly, the strands of second group of strand segments 222 of first strand configuration 200 are disposed beneath the strands of second strand group 1014 of fourth strand configuration 1000. With this arrangement, fiber reinforced plate 1200 may be provided with increased stability and strength by overlapping portions of reinforcing strands 210 and 1010.

FIG. 16 illustrates a cross-section of reinforced plate 1200 taken across a lateral direction in a portion of forefoot region 10 and/or midfoot region 12 along line 14-14. As shown in FIG. 16, substrate layer 202 including first strand configuration 200 is bonded to base plate 700 on one side and reinforcing strand 210 is disposed on the opposite side of substrate layer 202, in a similar manner as described above. Additionally, in this embodiment, substrate layer 1102 including fifth strand configuration 1100 having strand group 1112 formed by reinforcing strand 1110 is disposed above substrate layer 202. In an exemplary embodiment, strand group 1112 of fifth strand configuration 1100 may be located within the gap between first group of strand segments 220 and second group of strand segments 222 of first strand configuration 200 on substrate layer 202.

Next, substrate layer 1002 including fourth strand configuration 1000 is also bonded to base plate 700 and is disposed above substrate layer 1102 including fifth strand configuration 1100 and substrate layer 202 including first strand configuration 200. As described above, according to fourth strand configuration 1000, reinforcing strand 1010 is arranged into first strand group 1012 and second strand group 1014. As can be seen in FIG. 16, the strands of first group of strand segments 220 of first strand configuration 200 are disposed beneath the strands of first strand group 1012 of fourth strand configuration 1000. Similarly, the strands of second group of strand segments 222 of first strand configuration 200 are disposed beneath the strands of second strand group 1014 of fourth strand configuration 1000. Additionally, reinforcing strand 1110 of strand group 1112 of fifth strand configuration 1100 may be located beneath the gap between first strand group 1012 and second strand group 1014 of fourth strand configuration 1000 on substrate layer 1002.

In this embodiment, substrate layer 902 including third strand configuration 900 also bonded to base plate 700 and is disposed above substrate layer 1002 including fourth strand configuration 1000. As can be seen in FIG. 16, reinforcing strand 910 of third strand configuration 900 extends approximately laterally across fiber reinforced plate 1200 at the location of the cross-section view. With this arrangement, reinforcing strand 910 extends above each of reinforcing strand 210, reinforcing strand 1110, and reinforcing strand 1010. In this embodiment, reinforcing strand 910 is generally orthogonal to the direction of reinforcing strand 210, reinforcing strand 1110, and reinforcing strand 1010. With this arrangement, fiber reinforced plate 1200 may be provided with increased stability and strength across a lateral direction from reinforcing strand 910 embroidered onto substrate layer 902 according to third strand configuration 900.

Referring again to FIG. 16, in this embodiment, substrate layer 802 including second strand configuration 800 is bonded to base plate 700 such that substrate layer 802 is disposed on an outermost portion of fiber reinforced plate 1200. With this relation, substrate layer 802 is disposed above each of first substrate layer 202, fifth substrate layer 1102, fourth substrate layer 1002, and third substrate layer 902. As described above, second strand configuration 800 includes a plurality of ringed elements formed by concentric rings of reinforcing strand 810 embroidered onto substrate layer 802.

As can be seen in FIG. 16, third ringed element 816, fourth ringed element 818, and seventh ringed element 824 are shown in this cross-section view. The concentric rings formed by reinforcing strand 810 are shown spaced apart from each other such that they do not intersect. In addition, in this embodiment, the rings formed by reinforcing strand 810 of third ringed element 816 are disposed above the strands of first group of strand segments 220 of first strand configuration 200 and the strands of first strand group 1012 of fourth strand configuration 1000. Similarly, the rings formed by reinforcing strand 810 of seventh ringed element 824 are disposed above the strands of second group of strand segments 222 of first strand configuration 200 and the strands of second strand group 1014 of fourth strand configuration 1000. Additionally, the rings formed by reinforcing strand 810 of fourth ringed element 818 are generally disposed above reinforcing strand 1110 of strand group 1112 of fifth strand configuration 1100. With this arrangement, fiber reinforced plate 1200 may be provided with additional support and stability at locations corresponding to cleats and/or studs coinciding with the locations of third ringed element 816, fourth ringed element 818, and/or seventh ringed element 824.

FIG. 17 illustrates a cross-section of reinforced plate 1200 taken across a lateral direction in a portion of midfoot region 12 along line 17-17. As shown in FIG. 17, substrate layer 202 including first strand configuration 200 is bonded to base plate 700 on one side and reinforcing strand 210 is disposed on the opposite side of substrate layer 202, in a similar manner as described above. The cross section view shown in FIG. 17 is taken at a portion of midfoot region 12 of fiber reinforced plate 1200 that coincides with the location of cross-over area 224, where first group of strand segments 220 and second group of strand segments 222 cross and overlap each other according to first strand configuration 200. Additionally, in this embodiment, substrate layer 1102 including fifth strand configuration 1100 having strand group 1112 formed by reinforcing strand 1110 is disposed above substrate layer 202. In an exemplary embodiment, strand group 1112 of fifth strand configuration 1100 may be located above cross-over area 224 of first group of strand segments 220 and second group of strand segments 222 of first strand configuration 200 on substrate layer 202. With this arrangement, fiber reinforced plate 1200 may be provided with additional support and stability along a central spine or axis.

As described above with reference to exemplary process 100, fiber reinforced plate 1200 may be incorporated into a sole assembly and/or an article of footwear. For example, fiber reinforced plate 1200 may be attached or joined with an upper and/or other components to form an article of footwear. It should be understood that additional components may be molded onto fiber reinforced plate 1200. For example, cleats, studs, or other traction elements may be molded onto one side of fiber reinforced plate 1200. Further structural components may also be molded or bonded to fiber reinforced plate 1200 to provide additional stability or torsion control. In some cases, fiber reinforced plate 1200 may have material removed at certain locations to assist with flexibility of the plate. For example, flex notches may be made in fiber reinforced plate 1200 by removing material near outer perimeter 1204 at desired locations in forefoot region 10 to assist with bending of fiber reinforced plate 1200 at those locations. Additionally, other finishing steps and processes may be performed to prepare the reinforced plate for incorporation into a sole assembly and/or article of footwear.

In some embodiments, following the assembly of the different substrate layers with reinforced strands, heat and/or pressure may be applied to fuse the reinforced strands together (and/or to fuse the strands with the various substrate layers). Such a process may be similar to the steps described above and shown in FIG. 7.

Although the embodiment of FIGS. 9-17 depict the use of multiple substrate layers with strand configurations arranged in different regions or portions of a plate, in other embodiments a single layer could be used with strand configurations that extend through only one portion of a plate. For example, in one embodiment a reinforced plate could include reinforcing strands that extend through a heel and midfoot portion of a plate, but not through a forefoot portion (as shown in the layer of FIG. 13). In another embodiment, a reinforced plate could include reinforcing strands that are disposed only in a forefoot portion of a shoe and not in a heel portion or midfoot portion (as shown in the layer of FIG. 12). In still another embodiment, a reinforced plate could include reinforcing strands that are disposed only in a forefoot portion and a heel portion, but not a midfoot portion (as shown in the layer of FIG. 11). In still other embodiments, a plate could be reinforced in any other portions.

As described in the previous embodiments, one or more substrate layers including strand configurations are bonded or joined to a base plate. It should be understood that the orientation and order of the layers may be changed so that different portions are disposed on an exterior surface of the finished plate. Similarly, in some embodiments, substrate layers may be made from a substantially transparent material such that the reinforcing strand and/or threads used to attach the reinforcing strand to the substrate layers are visible through the fiber reinforced plate. In these embodiments, contrasting or coordinating colors for threads and/or reinforcing strands may be selected to provide a desired visual appearance to the fiber reinforced plate.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

The invention claimed is:

1. A method of forming a reinforced plate for a sole structure of an article of footwear, the method comprising:

attaching a first reinforcing strand to a first substrate layer according to a first strand configuration;

attaching at least one second reinforcing strand to a second substrate layer according to a second strand configuration, wherein the second strand configuration is different than the first strand configuration;

attaching the first substrate layer having the first reinforcing strand to a base plate; and attaching the second substrate layer having the at least one second reinforcing strand on top of the first substrate layer to form the reinforced plate;

wherein at least a portion of the first reinforcing strand overlaps at least a portion of the second reinforcing strand.

2. The method according to claim 1, further comprising:

attaching at least at least one third reinforcing strand to a third substrate layer according to a third strand configuration, wherein the third strand configuration is different than the first strand configuration and the second strand configuration; and attaching the third substrate layer having the at least one third reinforcing strand on top of the second substrate layer.

3. The method according to claim 2, wherein the at least one third reinforcing strand extends through at least a portion of a forefoot region and a portion of a heel region of the article of footwear; and wherein the first reinforcing strand extends through each of the forefoot region, a midfoot region, and the heel region of the article of footwear.

4. The method according to claim 3, wherein the at least one third reinforcing strand extends substantially laterally across the reinforced plate between a medial side and a lateral side; and wherein the first reinforcing strand extends substantially longitudinally across the reinforced plate from the forefoot region to the heel region of the reinforced plate.

5. The method according to claim 1, wherein the second strand configuration includes a plurality of separate ringed elements, each ringed element being formed by a reinforcing strand.

6. The method according to claim 5, wherein each ringed element is formed by multiple concentric rings of reinforcing strand that are spaced apart from one another such that the rings do not intersect each other.

7. The method according to claim 6, further comprising:

attaching a plurality of cleats to the reinforced plate at locations corresponding to locations of the plurality of separate ringed elements.

8. A reinforced plate for a sole structure of an article of footwear, the reinforced plate comprising:

a base plate;

a first substrate layer disposed on the base plate, the first substrate layer including a first reinforcing strand embroidered onto the first substrate layer according to a first strand configuration; and a second substrate layer disposed on one of the first substrate layer or the base plate, the second substrate layer including a second reinforcing strand embroidered onto the second substrate layer according to a second strand configuration, wherein the second strand configuration is different from the first strand configuration;

wherein at least a portion of the first reinforcing strand overlaps at least a portion of the second reinforcing strand.

9. The reinforced plate according to claim 8, wherein at least one of the first strand configuration and the second strand configuration includes concentric rings formed by a reinforcing strand.

10. The reinforced plate according to claim 8, wherein the first reinforcing strand is heat fused to the first substrate layer and wherein the second reinforcing strand is heat fused to the second substrate layer.

11. The reinforced plate according to claim 8, further comprising a plurality of additional substrate layers, each additional substrate layer including a reinforcing strand embroidered into a strand configuration that is different from each of the other strand configurations of the other substrate layers of the reinforced plate.

12. The reinforced plate according to claim 8, wherein the second strand configuration includes a plurality of separate ringed elements, each ringed element being formed by a reinforcing strand.

13. The reinforced plate according to claim 12, wherein each ringed element is formed by multiple concentric rings of reinforcing strand that are spaced apart from one another such that the rings do not intersect each other.

14. A reinforced plate for a sole structure of an article of footwear, the reinforced plate comprising:

a base plate;

a first substrate layer disposed on the base plate, the first substrate layer including a first reinforcing strand embroidered onto the first substrate layer according to a first strand configuration;

a second substrate layer disposed on one of the first substrate layer or the base plate, the second substrate layer including a second reinforcing strand embroidered onto the second substrate layer according to a second strand configuration, wherein the second strand configuration is different from the first strand configuration; and a third substrate layer disposed on one of the first substrate layer, the second substrate layer, or the base plate;

wherein the third substrate layer includes a third reinforcing strand embroidered onto the third substrate layer according to a third strand configuration, wherein the third strand configuration is different from both the second strand configuration and the first strand configuration.

15. The reinforced plate according to claim 14, wherein the third reinforcing strand extends through at least a portion of a forefoot region and a portion of a heel region of the article of footwear; and wherein the first reinforcing strand extends through each of the forefoot region, a midfoot region, and the heel region of the article of footwear.

16. The reinforced plate according to claim 14, wherein the third reinforcing strand extends substantially laterally across the reinforced plate between a medial side and a lateral side; and wherein the first reinforcing strand extends substantially longitudinally across the reinforced plate from the forefoot region to the heel region of the reinforced plate.

17. The reinforced plate according to claim 14, wherein at least a portion of the first reinforcing strand overlaps at least a portion of the second reinforcing strand.

18. The reinforced plate according to claim 14, wherein at least one of the first strand configuration and the second strand configuration includes concentric rings formed by a reinforcing strand.

19. The reinforced plate according to claim 14, wherein the first reinforcing strand is heat fused to the first substrate layer and wherein the second reinforcing strand is heat fused to the second substrate layer.

20. The reinforced plate according to claim 14, further comprising a plurality of additional substrate layers, each additional substrate layer including a reinforcing strand embroidered into a strand configuration that is different from each of the other strand configurations of the other substrate layers of the reinforced plate.

* * * * *